US012305483B2

(12) United States Patent
Saraya et al.

(10) Patent No.: US 12,305,483 B2
(45) Date of Patent: May 20, 2025

(54) METHODS AND SYSTEMS FOR FRAC PLUGS AND DOWNHOLE TOOLS

(71) Applicant: Vertice Oil Tools, Inc., Stafford, TX (US)

(72) Inventors: Mohamed Saraya, Sugar Land, TX (US); Mike Lo, Houston, TX (US); Stephen Parks, Houston, TX (US)

(73) Assignee: Vertice Oil Tools, Inc., Missouri City, TX (US)

( * ) Notice: Subject to any disclaimer, the term of this patent is extended or adjusted under 35 U.S.C. 154(b) by 0 days.

(21) Appl. No.: 18/543,890

(22) Filed: Dec. 18, 2023

(65) Prior Publication Data

US 2024/0117710 A1 Apr. 11, 2024

Related U.S. Application Data

(63) Continuation of application No. PCT/US2022/035434, filed on Jun. 29, 2022.

(60) Provisional application No. 63/217,934, filed on Jul. 2, 2021.

(51) Int. Cl.
*E21B 34/14* (2006.01)

(52) U.S. Cl.
CPC ..... *E21B 34/14* (2013.01); *E21B 2200/05* (2020.05)

(58) Field of Classification Search
CPC .... E21B 2200/05; E21B 34/063; E21B 34/14; E21B 34/103
See application file for complete search history.

(56) References Cited

U.S. PATENT DOCUMENTS

| | | | | |
|---|---|---|---|---|
| 10,087,695 | B1 * | 10/2018 | Woods | E21B 23/02 |
| 11,255,151 | B2 * | 2/2022 | Nichols | E21B 33/1293 |
| 2002/0079104 | A1 * | 6/2002 | Garcia | E21B 34/06 166/373 |
| 2006/0124315 | A1 * | 6/2006 | Frazier | E21B 43/14 166/332.8 |
| 2006/0272824 | A1 * | 12/2006 | Adams | E21B 34/142 166/373 |
| 2007/0095533 | A1 * | 5/2007 | Rogers | E21B 33/14 166/285 |
| 2011/0290344 | A1 * | 12/2011 | Groesbeck | E21B 34/16 137/430 |
| 2016/0138366 | A1 * | 5/2016 | Broussard | E21B 34/14 166/305.1 |
| 2018/0051532 | A1 * | 2/2018 | Smith | E21B 34/10 |
| 2018/0112493 | A1 * | 4/2018 | Recchioni | E21B 34/10 |
| 2019/0376366 | A1 * | 12/2019 | Burris | E21B 34/063 |
| 2021/0131225 | A1 * | 5/2021 | Churchill | E21B 21/10 |
| 2021/0164306 | A1 * | 6/2021 | Eis | E21B 34/14 |
| 2021/0396094 | A1 * | 12/2021 | Taha | E21B 34/14 |

* cited by examiner

*Primary Examiner* — Shane Bomar
(74) *Attorney, Agent, or Firm* — Pierson IP, PLLC

(57) ABSTRACT

A downhole tool with a flapper positioned within a mandrel. More specifically, embodiments are directed toward flappers with different mechanisms to open and close the flapper.

10 Claims, 22 Drawing Sheets

METHODS AND SYSTEMS FOR FRAC PLUGS AND DOWNHOLE TOOLS

BACKGROUND INFORMATION

Field of the Disclosure

Examples of the present disclosure relate to downhole tools with an object to form a seal. More specifically, embodiments are directed toward different types of downhole tools that can be resettable or single-use frac plugs.

Background

Conventionally, after casing and cementing a well and to achieve Frac/zonal isolation in a Frac or stimulation operation, a frac plug and perforation guns on a wireline are pushed/pumped downhole to a desired depth. Then, a frac plug is set and perforation guns are fired above to create conduit to frac fluid. This enables the fracing fluid to be pumped to the newly created conduit while isolating it from zones below using the frac plug. Typically, to aid in allowing the assembly of perforation and frac plug to reach the desired depth, specifically in horizontal or deviated laterals, pumping operation can be used. During the pumping operation, the wireline is pumped down the hole with the aid of flowing fluid.

Conventional flac plugs utilize a ball that is dropped from the surface and isolated on the frac plug, this ensures a contingency of pumping another plug or downhole tools is available in case the gun misfire, this requires pumping the ball from the surface which consume time and fluid if the ball is run on the seat with the frac plug then it requires the well to flow back in case of gun misfire, this can be somewhat challenging if the well doesn't possess enough energy to flow. Having a ball trap in the running tool is a solution, yet it still requires a certain flow rate to allow the ball to flow back. Further, some other plugs utilize rupture discs that rupture based on a pressure differential between the zones above and below the frac plug to establish communication across the rupture disc. However, this creates scalable problems, where each stage of a wellbore requires rupture discs of different values. This can also cause situations where ruptured discs may prematurely break.

Accordingly, needs exist for systems and methods utilizing frac plugs with a new interior design to isolate areas within a wellbore, wherein in certain embodiments the new interior may be resettable or a single-used interior.

SUMMARY

Embodiments disclosed herein describe systems and methods for a frac plug. The frac plug may include a mandrel and an object, a flapper, or a disc (referred to hereinafter collectively or individually as "flapper"). In embodiments, the object may be any geometric shape and formed of various materials, and is configured to selectively form a seal across the frac plug or other downhole tools.

The mandrel may be a shaft, cylindrical rod, etc. that is configured to form the body of the frac plug.

The flapper or object may be configured to rotate from a position blocking an inner diameter of the frac plug to a position allowing fluid to flow around the flapper. However, in other embodiments, the flapper may be any object of any geometry that is configured to isolate a first area above the housing from a second area below the housing. For example, the flapper may be a cylindrical plug.

An embodiment may include a slot through the flapper, a channel within the flapper, a shaft with a groove, a ball, and a force-creating device.

The slot may extend through the body of the flapper, and extend in a direction perpendicular to the central axis of the mandrel. The slot may be configured to receive the shaft.

The channel within the flapper may be an indentation, groove, cutout, etc. positioned within the slot, wherein the channel is configured to house the ball and the force-creating device, wherein the ball may be spherical in shape or any sized and shaped object.

The shaft may be configured to extend through the slot and couple the flapper to the mandrel of the frac plug. A first end of the shaft may be coupled to the first portion of the circumference of the mandrel, and a second end of the shaft may be coupled to the second portion of the circumference of the mandrel. The shaft may be configured to be fixed in place while the flapper rotates around an axis defined by a central axis of the shaft.

The groove may be a depression, slot, channel, seat, etc. positioned on the circumference of the shaft, which extends in a plane parallel to a central axis of the mandrel. When the ball is positioned on the groove, a sufficient rotational force may be required to overcome the mechanical force created by the ball within the groove to rotate the flapper in the first direction. After sufficient mechanical force is applied, the ball may rotate along the smoother circumference of the shaft. This may enable the flapper to rotate to be positioned on the profile, forming a seal across the mandrel. Later, responsive to rotating the flapper in a second direction due to flowing fluid, the ball may be reinserted into the groove. This may once again secure the flapper in an open position.

The channel may be configured to the ball and the force-creating device. The force-creating device may be a spring, piston, or any other device that is configured to create a constant linear force on the ball against the shaft. The linear force created by the ball may limit or restrict the rotation of the flapper when the ball is positioned on the groove.

Another embodiment may include a slot through the flapper, a first channel within the flapper, a second channel within a shaft, and a shear pin. The first channel within the flapper and the second channel within the shaft may be configured to be aligned with each other to receive the shear pin, wherein the shaft extends through the slot. The shear pin may be configured to retain the flapper in the first position until sufficient force is applied against the flapper to break the shear pin. Responsive to the shear pin breaking, the flapper may be seated in a closed position. However, when the shear pin breaks, the shear pin may no longer be able to retain the flapper in the locked and opened position.

Another embodiment may include a slot through the flapper, a shaft, a first channel through the flapper, and a shear pin. The shaft may be configured to extend through the slot to provide an axis of rotation of the flapper. The shear pin may be configured to be positioned through the first channel in the flapper. A first end of the shear pin may be initially coupled to the first portion of the circumference of the mandrel, and a second end of the shear pin may be initially coupled to a second portion of the circumference of the mandrel. When the shear pin is intact, the shear pin may retain the flapper in an open position. Responsive to providing sufficient force against the flapper, the shear pin may break, allowing the flapper to rotate to seal the mandrel.

Another embodiment may include a slot through the flapper and a shaft. The shaft may be configured to extend through the slot to provide an axis of rotation of the flapper.

The shaft may include weak points, wherein the weak points have a reduced thickness of the shaft. Responsive to applying sufficient force against the flapper, the forces may be large enough to break the weak points in the shaft. This may disengage the shaft from the mandrel, allowing the flapper to rotate, be seated on the profile, and seal the mandrel.

Another embodiment may include a flapper and an insert. The insert may be configured to be mounted on an inner diameter of the mandrel via shear screws. A first portion of the insert may be coupled to a lower surface of the flapper to retain the flapper in an open position when the insert is coupled to the mandrel. Responsive to a sufficient force being applied to the flapper, the flapper may transfer these forces to the insert, and the shear screws may break. When the shear screws break, the insert may flow downhole, allowing the flapper to close.

In other embodiments, the flapper may be mounted inside the insert and run in a hole in the closed position. The flapper or any other object may be positioned within the insert and positioned in the closed position before the insert is positioned downhole. This may enable the flapper to be pumped downhole along with the insert in the closed position. This may eliminate the need to drop balls downhole to isolate the wellbore or require shifting tools to set a flapper downhole. By positioning the flapper in the closed position within the insert before positioning the housing within the hole or down well, there is no need to drop and pump a dissolvable ball downhole. Nor is it necessary to wait a few days to allow the ball to dissolve to allow for pumping. By positioning the object within the insert or directly on the mandrel, the ability to pump may be established directly after testing.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described concerning the following figures, wherein reference numerals refer to like parts throughout the various views unless otherwise specified.

Figure 1:
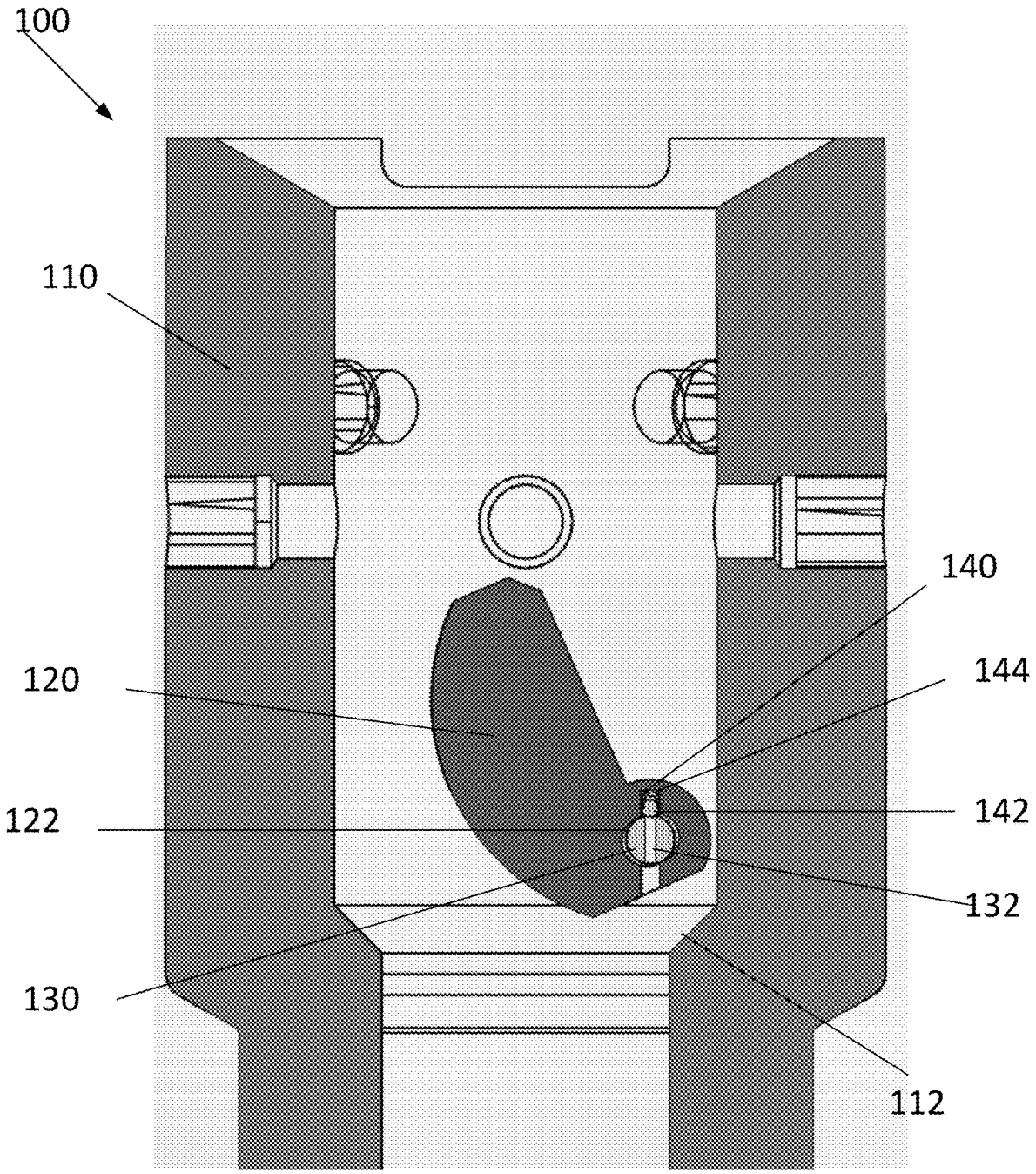
FIG. 1 depicts a cross-sectional view of a downhole tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted to facilitate a less obstructed view of these various embodiments of the present disclosure.

DETAILED DESCRIPTION

In the following description, numerous specific details are outlined to provide a thorough understanding of the present invention. It will be apparent, however, to one having ordinary skill in the art that the specific detail need not be employed to practice the present invention. In other instances, well-known materials or methods have not been described in detail to avoid obscuring the present invention.

FIG. 1 depicts a cross-sectional view of a downhole tool 100, according to an embodiment. The downhole tool 100 may be a frac plug that is configured to isolate areas of a geological formation. The downhole tool 100 may include mandrel 110, flapper 120, and shaft 130.

Mandrel 110 may be a tube, cylinder, rod, etc. that is configured to form a body of downhole tool 100. Mandrel 110 may include a profile 112 that reduces the inner diameter of mandrel 110. Profile 112 may be configured to act as a seat to receive a lower surface of flapper 120. When the lower surface of flapper 120 is seated on profile 112, a seal may be formed across the inner diameter of mandrel 110. Profile 112 may be a ledge that is perpendicular to a central axis of the downhole tool 100 or maybe a tapered sidewall that gradually and incrementally decreases the inner diameter of mandrel 110. In other embodiments, a profile 112 may be part of a seat that is connected to the mandrel while the mandrel maintains the same inner diameter.

Flapper 120 may be a rotatable disc formed of brass, composite, aluminum, cast iron, or any other material that can dissolve over time due well fluid and temperature.

Flapper 120 may be configured to rotate from a first position that allows fluid to flow around flapper 120, to a second position where flapper 120 is seated on profile 120 and blocking an inner diameter of mandrel 110. Flapper 120 may be a free-floating component that is mounted to mandrel 110 via shaft 130. Shaft 130 is inserted into slot 122 and extends through the body of the flapper 120, wherein slot 122 and shaft 130 extend in a direction perpendicular to the central axis of mandrel 110. Flapper 120 may also include a channel 140. Channel 140 may be a slot, opening, etc. positioned through slot 122, wherein the length of channel 140 may be greater than the diameter across slot 122. Channel 140 may be configured to house ball 142 and force-generating device 144.

Shaft 130 may be configured to be inserted into slot 122, and have a first end coupled to a first portion of the mandrel 110, and a second end coupled to a second portion of the mandrel 110. This may enable shaft 130 to be fixed in place, while flapper 120 rotates around shaft 130. As such, shaft 130 may create an axis of rotation where flapper 120 may rotate. Shaft 130 may include a groove 132, which may be a depression, slot, seat, etc. extending from an outer diameter of shaft 130 towards or through a central axis of shaft 130.

Groove 132 may be configured to selectively receive ball 142, such that forces created upon ball 142 may be transferred to shaft 130 against the sidewalls created by groove 132. In embodiments, responsive to flapper 120 rotating, ball 142 may be disengaged from groove 132 and be able to rotate around a smoother portion of the circumference of shaft 130. However, when ball 142 is seated on groove 132, forces acting upon flapper 120 may be required to be greater than a force created by ball 142 against groove 132 to rotate. This may allow for a controlled rotation of flapper 120 based on the external forces created by the flow of fluid around flapper 120 and the internal forces created by ball 142 against groove 132 and the outer circumference of shaft 130.

Channel 140 may be a chamber, slot, opening, etc. positioned through slot 122, wherein the length of channel 140 may be greater than the diameter across slot 122. Channel 140 may be configured to house ball 142 and force-generating device 144.

Force-generating device 144 may be a spring, piston, hydraulic chamber, or any other device or element that is configured to provide a constant and continual force against ball 142 towards a central axis of shaft 130. In embodiments, the force generated by force-generating device 144 may be a constant force, which may be transferred to ball 142 towards the central axis of shaft 130. These forces may be utilized to retain ball 142 within groove 132. When ball 142 is seated within groove 132, the amount of force needed to rotate flapper 120 may be the first amount due to the additional surface area and ledges, and profile created by groove 132. However, when ball 142 is not seated within groove 132, the amount of force needed to rotate flapper 120 may be a second amount, which is less than the first amount. The second amount may be based on ball 142 being able to roll on an outer circumference of shaft 130.

To this end, flapper 120 may open and close based on the mechanical friction of elements positioned within flapper 120 and hydraulic forces applied to the external surfaces of flapper 120.

Figure 2:
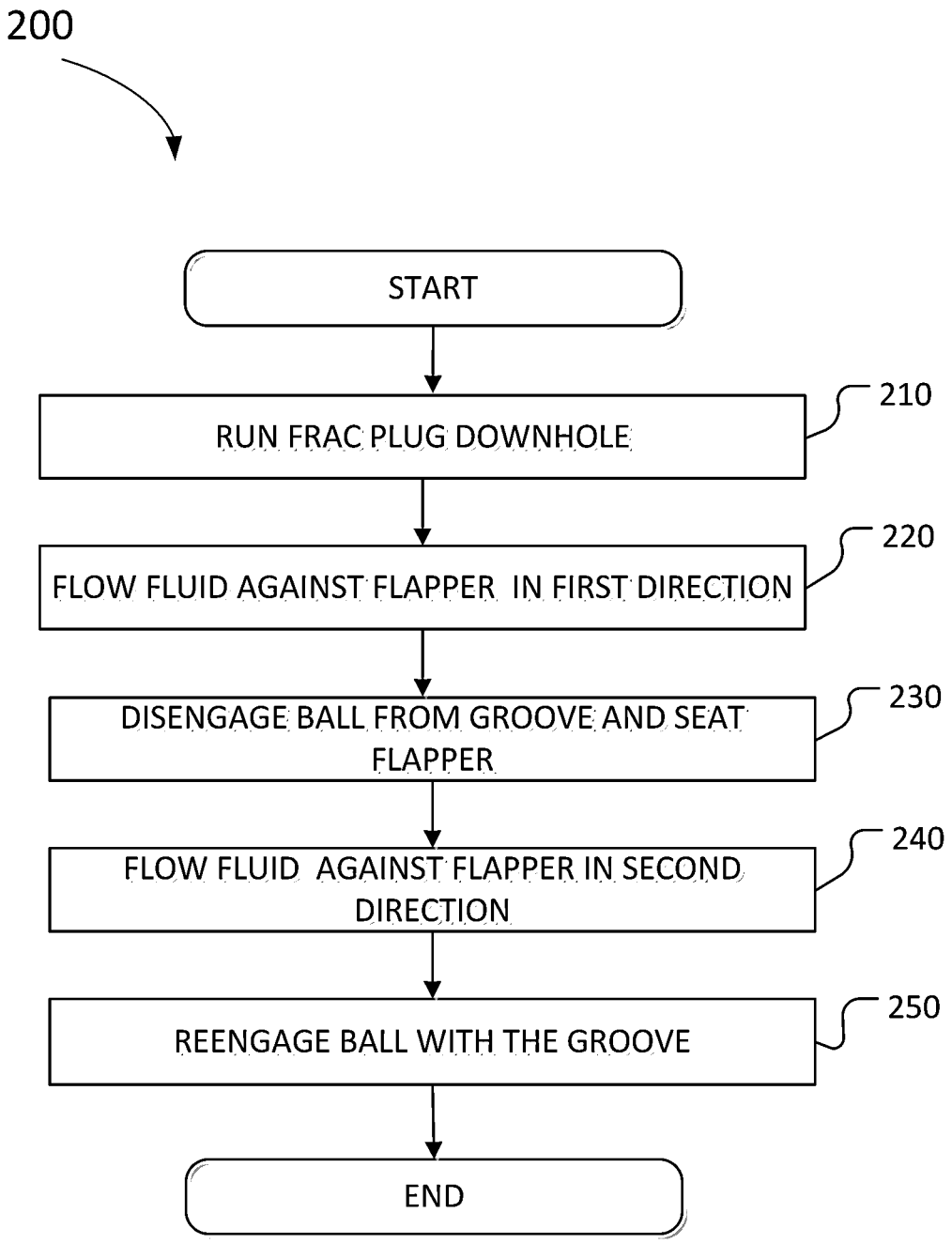
FIG. 2 depicts a method for utilizing a frac plug with a flapper, according to an embodiment.

FIG. 2 depicts a method 200 for utilizing a frac plug with a flapper, according to an embodiment. The operations of method 200 presented below are intended to be illustrative. In some embodiments, method 200 may be accomplished with one or more additional operations not described, and/or without one or more of the operations discussed. Additionally, the order in which the operations of method 200 are illustrated in FIG. 2 and described below is not intended to be limiting.

At operation 210, a downhole tool, such as a frac plug, may be run in the hole and set at a desired depth. The downhole tool may be run in a hole with a flapper in an open position, which may allow fluid to flow through a mandrel. When in the open position, a ball or object positioned internally within the flapper may provide a force against a groove within a shaft, wherein the shaft provides an axis of rotation of the flapper.

At operation 220, fluid may flow in the first direction against an upper surface or lower surface of the flapper. The fluid flowing against the upper or lower surface of the flapper may be greater than the first rotating threshold, wherein the first rotating threshold is based on an amount of internal force created by the ball or the object against the groove.

At operation 230, responsive to the force against the external surface of the flapper being greater than the rotating threshold, the flapper may rotate in the first direction to move from an open position to a closed position. In the second position, the flapper is seated across a mandrel of the downhole tool. When the flapper is rotating from the open position to the closed position, the ball may disengage from the groove and rotate against the circumference of the shaft applying a constant pressure against the shaft. However, due to the shaft having a smooth circumference other than the groove, the ball may freely and more easily rotate against other portions of the shaft than when inserted into the groove.

At operation 240, fluid may flow in a second direction against an external surface of the flapper. The flow of fluid in the second direction against the external surface of the flapper may be greater than a second rotating threshold, wherein the second rotating threshold is based on an amount of internal force created by the ball or the object directly moving along the smooth outer circumference of the shaft. The second rotating threshold may be close to a null amount of force, which may be substantially less than the first rotating threshold.

At operation 250, the flapper may rotate based on the fluid flowing in the second direction until the ball is positioned within the groove, which may secure the flapper in a partially opened position.

Figure 3A:
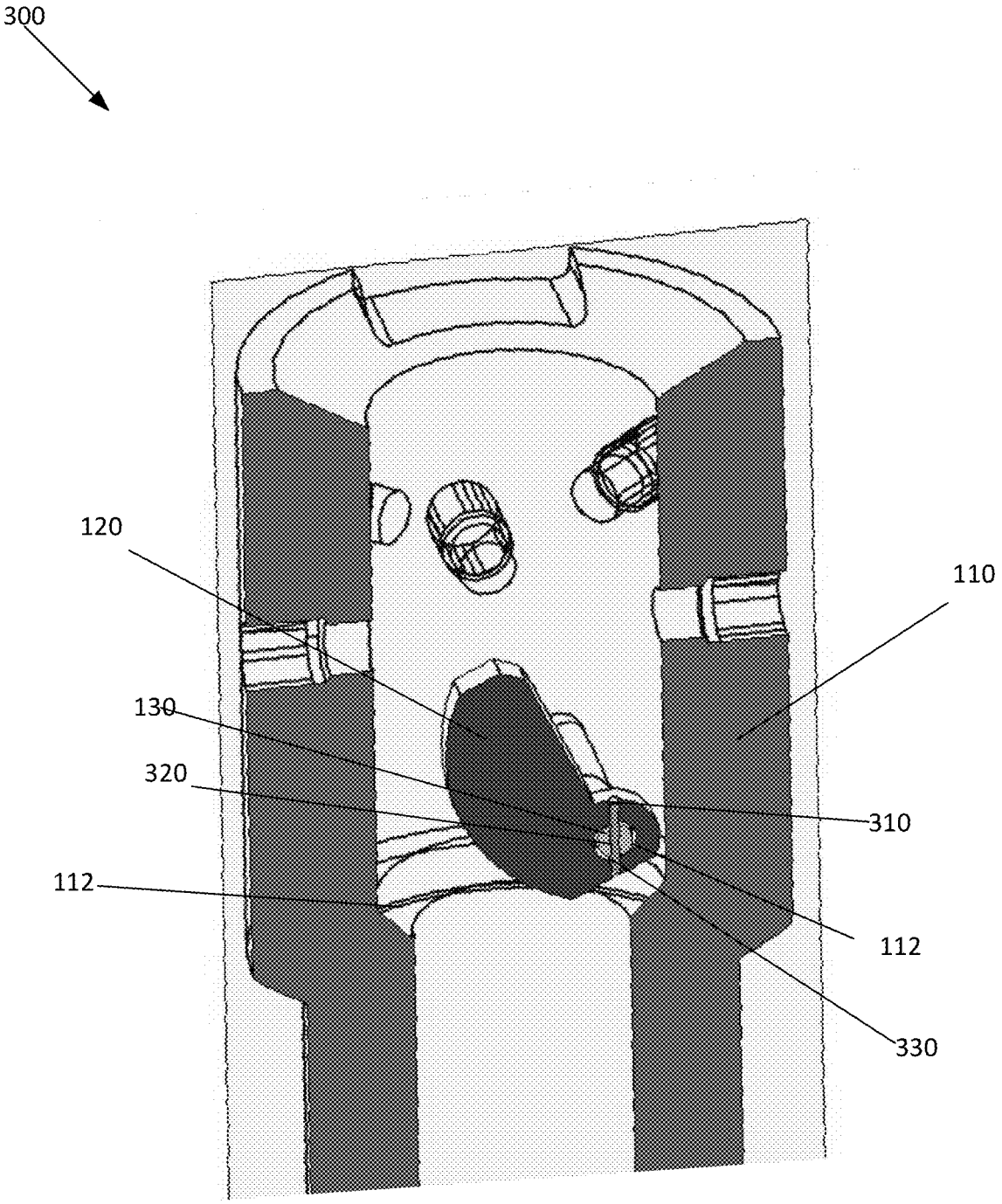
FIG. 3A depicts a cross-sectional view of a downhole tool, according to an embodiment.

FIG. 3A depicts a cross-sectional view of a downhole tool 300, according to an embodiment. Elements depicted in FIG. 3A may be described above, and for the sake of brevity, a further description of these items may be omitted. The downhole tool 300 may be a frac plug that is configured to isolate areas of a geological formation. The downhole tool 300 may include a mandrel 110, flapper 120, and shaft 130, wherein flapper 120 is run in a hole in an open position, and is configured to close after shearing shear pin 330.

Similarly to downhole tool 100, downhole tool 300 may include a flapper 120 that is configured to be positioned on a profile 112 on an inner diameter of mandrel 110 to form a seal. Additionally, flapper 120 may be configured to be positioned within a slot 122 of flapper 120. Furthermore, flapper 120 may include a first channel 310. First channel 310 may be a slot, opening, etc. positioned through slot 122, wherein at least one end of the first channel 310 is exposed.

Second channel 320 may be a slot, opening, etc. positioned across a diameter of shaft 130. Second channel 320 may be configured to extend in an axis that is perpendicular to the central axis of shaft 320. First channel 310 may be configured to be aligned with second channel 320 to form a continuous channel through flapper 120 and shaft 130, wherein a shear pin 330 may be positioned through the continuous channel.

Shear pin 330 may be any type of temporary coupling mechanism that is configured to break, shear, etc. responsive to a force being applied to shear pin 330 being greater than a force threshold. In embodiments, shear pin 330 may be configured to be directly inserted into flapper 120 and extend through an axis of rotation of flapper 120. When shear pin 330 is intact and positioned through first channel 310 and second channel 320, flapper 120 may be locked in place. Responsive to flowing fluid across flapper 120 at a high enough flow rate, flapper 120 may rotate creating a force against shear pin 330 that is higher than a pressure threshold. This may cause shear pin 330 to shear. The shearing of shear pin 330 may allow flapper 120 to rotate to be positioned on profile 112, and form a seal across profile 112. However, because shear pin 330 has sheared, flapper 120 may not be able to be reset into a locked and open position. However, even after shear pin 330 is sheared, flapper 120 may still be utilized to seal the mandrel responsive to flowing fluid against an upper surface of flapper 120.

Figure 3B:
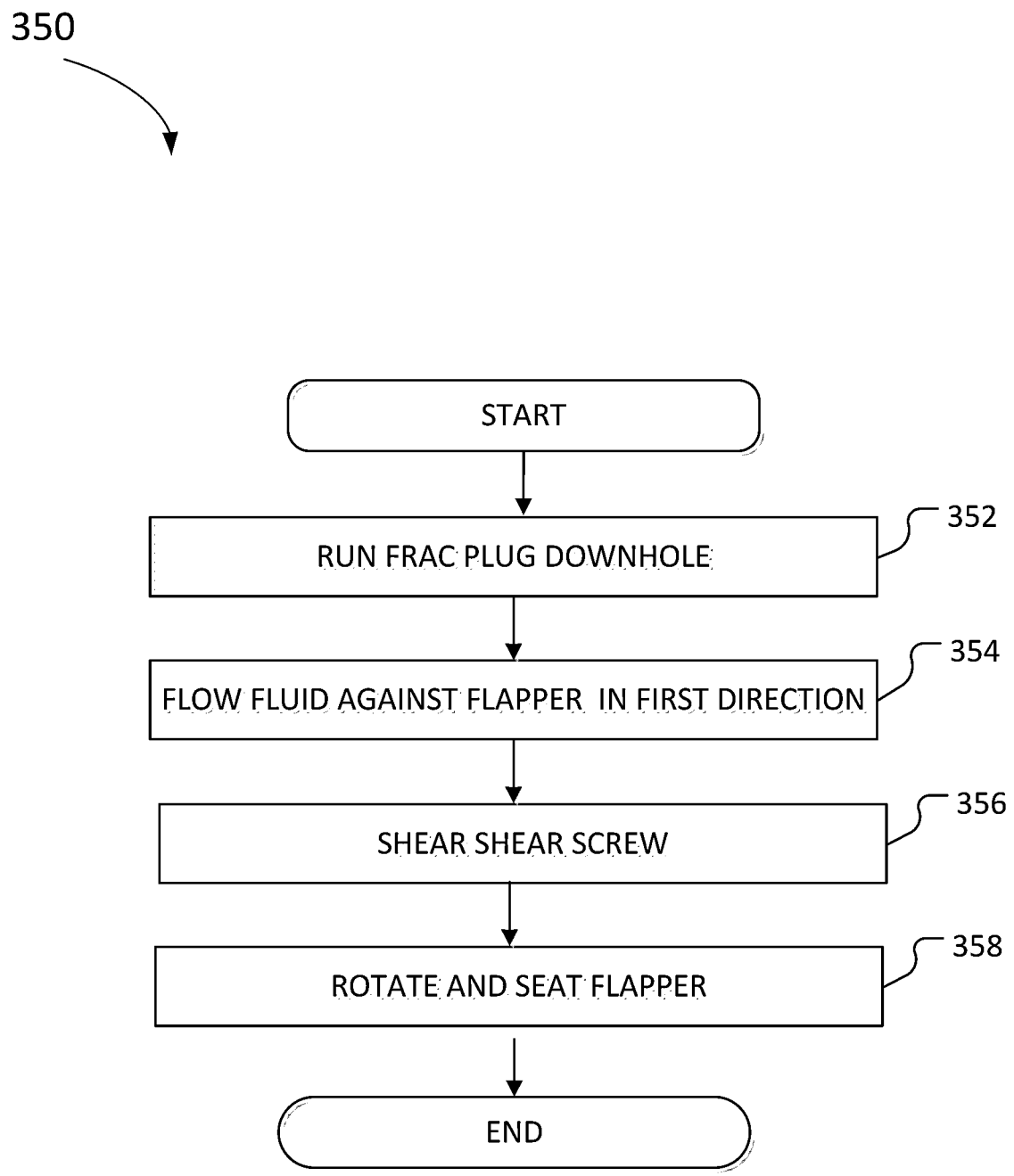
FIG. 3B depicts a method for utilizing a downhole tool with a flapper, according to an embodiment.

FIG. 3B depicts a method 350 for utilizing a downhole tool with a flapper, according to an embodiment. The operations of method 350 presented below are intended to be illustrative. In some embodiments, method 350 may be accomplished with one or more additional operations not described, and/or without one or more of the operations discussed. Additionally, the order in which the operations of method 350 are illustrated in FIG. 3B and described below is not intended to be limiting.

At operation 352, a downhole tool may be run in a hole and set at a desired depth. The downhole tool may be run in a hole with a flapper in an open position, which may allow fluid to flow through a mandrel.

At operation 354, fluid may flow in the first direction against an upper surface or lower surface of the flapper. The fluid flowing against the upper or lower surface of the flapper may be greater than the first rotating threshold, wherein the first rotating threshold is based on the amount of force required to shear a shear pin.

At operation 356, responsive to the force against the external surface of the flapper being greater than the rotating threshold, the shear pin may shear.

At operation 358, due to the shear pin no longer applying forces to retain the flapper in the open position and the flow of fluid in the first direction, the flapper may rotate from an open position to a closed position. In the closed position, the flapper is seated across a mandrel of the flac plug.

Figure 4:
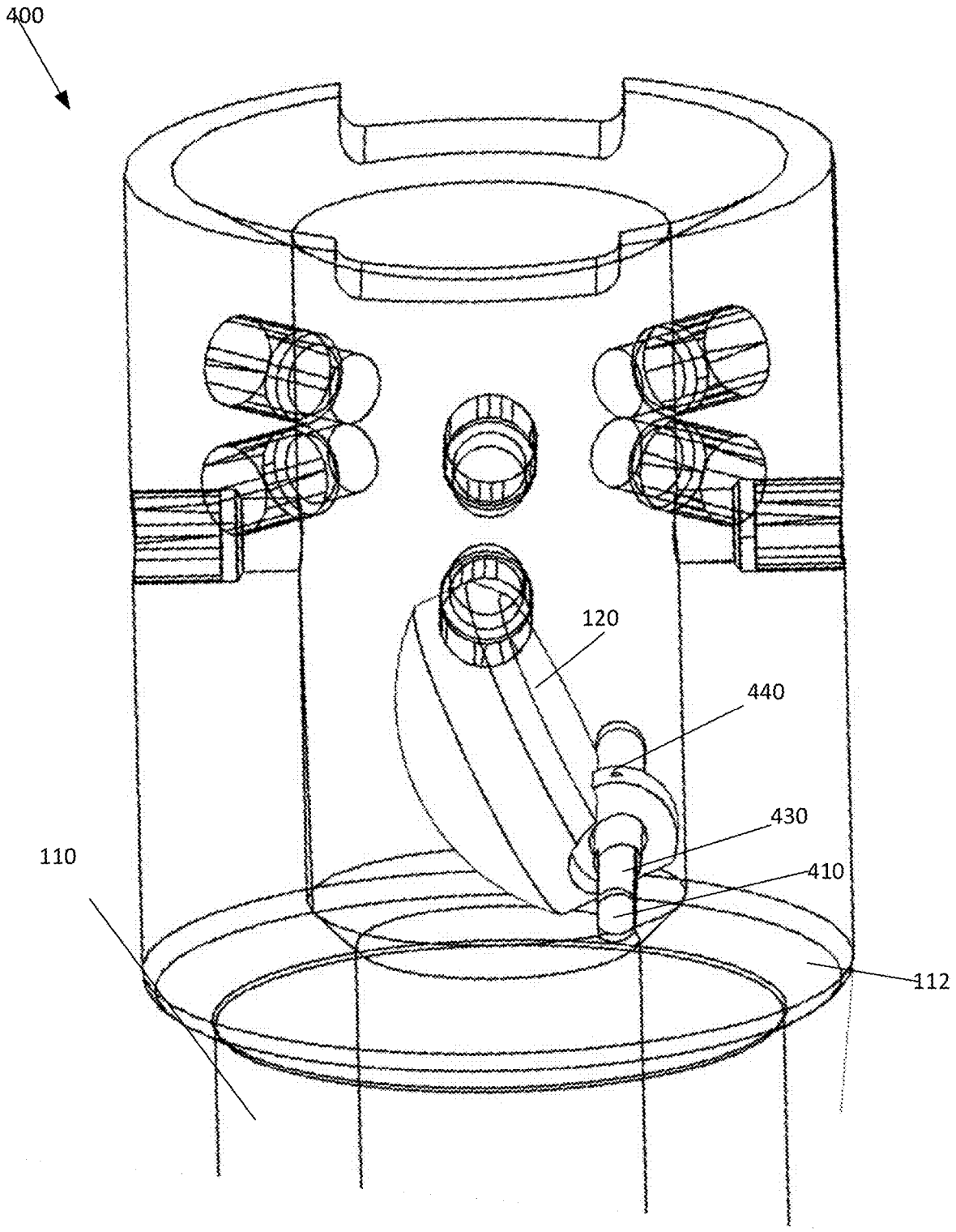
FIG. 4 depicts a perspective view of a downhole tool, according to an embodiment.

FIG. 4 depicts a perspective view of a downhole tool 400, according to an embodiment. Elements depicted in FIG. 4 may be described above, and for the sake of brevity, a further description of these items may be omitted. The downhole tool 400 may be a frac plug that is configured to isolate areas of a geological formation. The downhole tool 400 may include a mandrel 110, flapper 120, and deformable shaft 430.

Deformable shaft 430 may be a non-cylindrical shaft that is configured to be coupled to flapper 120 via a set screw 440. Set screw 440 may be configured to translate forces applied to flapper 120 to deformable shaft 430 to allow deformable shaft 430 to deform, which in turn may allow flapper 120 to rotate.

Ends 410 of shaft 430 may be non-cylindrical in shape. For example, the ends 410 of shafts 430 may be oblong, oval, rectangular, square, etc. in shape, wherein the ends 410 of shaft 430 are configured to be directly inserted into slots within mandrel 110. The slots in mandrel 110 may not have a corresponding shape. For example, the slots in the mandrel may be a circular hole. Responsive to a force being applied to an upper surface of flapper 120, flapper 120 will translate these forces to shaft 430 to deform shaft 430. Flapper 120 may be configured to resist rotating from the open position to the closed position. However, when and while shaft 430 is deformed, flapper 120 may rotate from the open position to the closed position. The deformation of shaft 430 due to the ends 410 of shaft 430 being non-cylindrical in shape and being positioned within non-corresponding slots in mandrel 110 may allow flapper 120 to rotate in a first direction and form a seal across profile 112.

More specifically, the squared end 410 of shaft 430 may resist closing flapper 120 until a sufficient force is applied to shaft 430 to deform shaft 430.

Furthermore, flapper 120 may be configured to rotate in a second direction to open a passageway through mandrel 110 when fluid flows against a lower surface of flapper 120. Due to the deformation of shaft 430, the amount of force required to rotate the flapper 120 in the second direction when flapper 120 is positioned across profile 112 may be substantially less than the amount of force required to initially rotate flapper 120 to form the seal.

Figure 5:
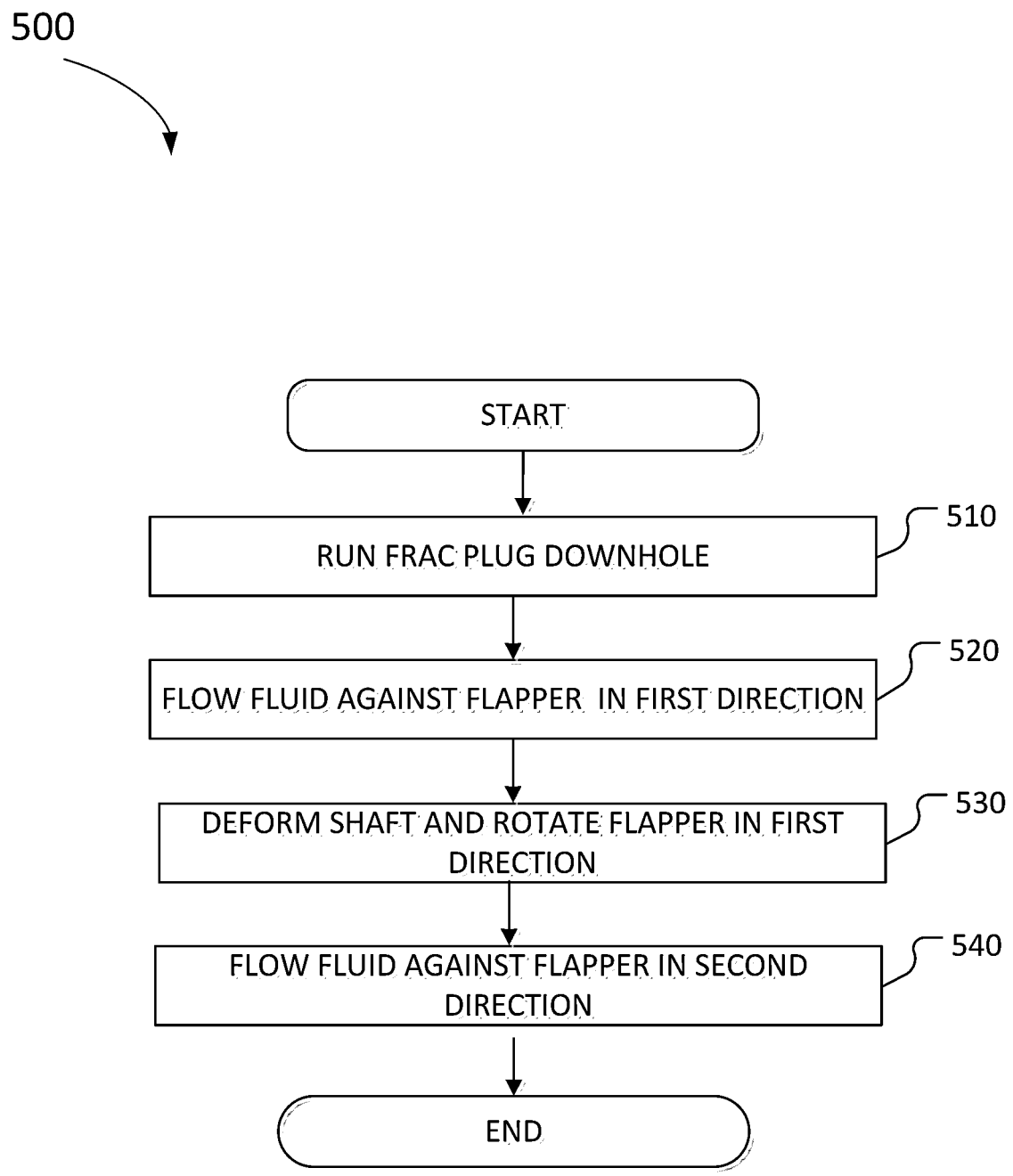
FIG. 5 depicts a method for utilizing a downhole tool with a flapper, according to an embodiment.

FIG. 5 depicts a method 500 for utilizing a downhole tool with a flapper, according to an embodiment. The operations of method 500 presented below are intended to be illustrative. In some embodiments, method 500 may be accomplished with one or more additional operations not described, and/or without one or more of the operations discussed. Additionally, the order in which the operations of method 500 are illustrated in FIG. 5 and described below is not intended to be limiting.

At operation 510, a downhole tool may be run in a hole and set at a desired depth. The downhole tool may be run in a hole with a flapper in an open position, which may allow fluid to flow through a mandrel. When running in a hole, a set screw may be inserted through the flapper and the shaft to couple the shaft and flapper together.

At operation 520, fluid may flow against the upper surface of the flapper. The fluid flowing against the upper surface of the flapper may cause the flapper to create a first force against the shaft via the set screw that is greater than the first threshold, wherein the first force threshold is associated with an amount of force required to deform the shaft.

At operation 530, responsive to the forces caused by the flapper against the force threshold, the shaft may permanently deform. This may enable the flapper may rotate from an open position to a closed position, wherein the flapper is seated across a mandrel of the flac plug.

At operation 540, fluid may flow against a lower surface of the flapper. The flowing of any fluid against the lower surface of the shaft may be translated to the shaft via the set screw and enable the flapper to rotate from the seated position to the open position. Furthermore, due to the deformation of the shaft, any amount of fluid flowing against the lower surface of the flapper may enable the flapper to rotate to the open position. In other words, after the shaft is deformed, a lower amount of force against the flapper may be necessary to move the shaft between an open or closed position.

Figure 6:
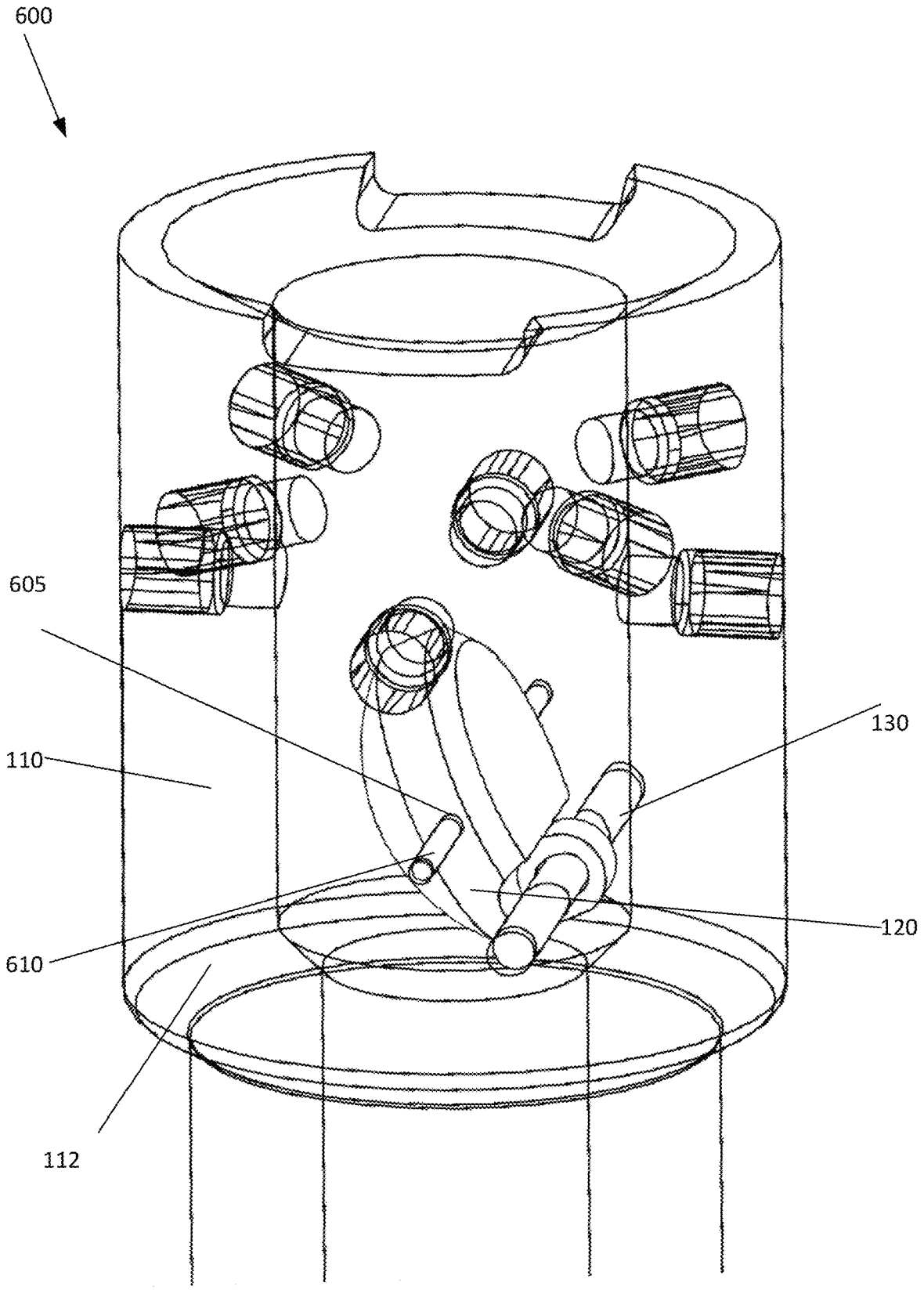
FIG. 6 depicts a perspective view of a downhole tool, according to an embodiment.

FIG. 6 depicts a perspective view of a downhole tool 600, according to an embodiment. Elements depicted in FIG. 6 may be described above, and for the sake of brevity, a further description of these items may be omitted. The downhole tool 600 may be a frac plug that is configured to isolate areas of a geological formation. The downhole tool 600 may include mandrel 110, flapper 120, shaft 130, and shear pin 610.

Shear pin 610 may be a temporary coupling mechanism that is configured to shear responsive to a force being applied to shear pin 610 being greater than a force threshold. Shear pin 610 may be configured to be inserted into channel 605 extending through a body of flapper 120, which may extend through a central axis of mandrel 110. A first end of shear pin 610 may be directly coupled to a first portion of mandrel 110 and a second end of shear pin 610 may be directly coupled to a second portion of mandrel 110, such that shear pin 610 extends across the inner diameter of mandrel 110. The positioning of shear pin 610 through an entire width of flapper 120 and across the entire inner diameter of the mandrel 110 may allow shear pin 610 to receive a maximum amount of force from flapper 120 while being positioned away from an axis of rotation of flapper 120.

When shear pin 610 is intact and positioned through channel 605, flapper 120 may be locked in place. Responsive to flowing fluid across flapper 120 at a sufficient flow rate to create a force against shear pin 610 that is higher than a pressure threshold, shear pin 610 may shear. The shearing of shear pin 610 may allow flapper 120 to rotate to be positioned on profile 112, and form a seal across mandrel 110. However, because shear pin 610 has sheared, flapper 120 may not be able to be reset into a locked position.

Figure 7:
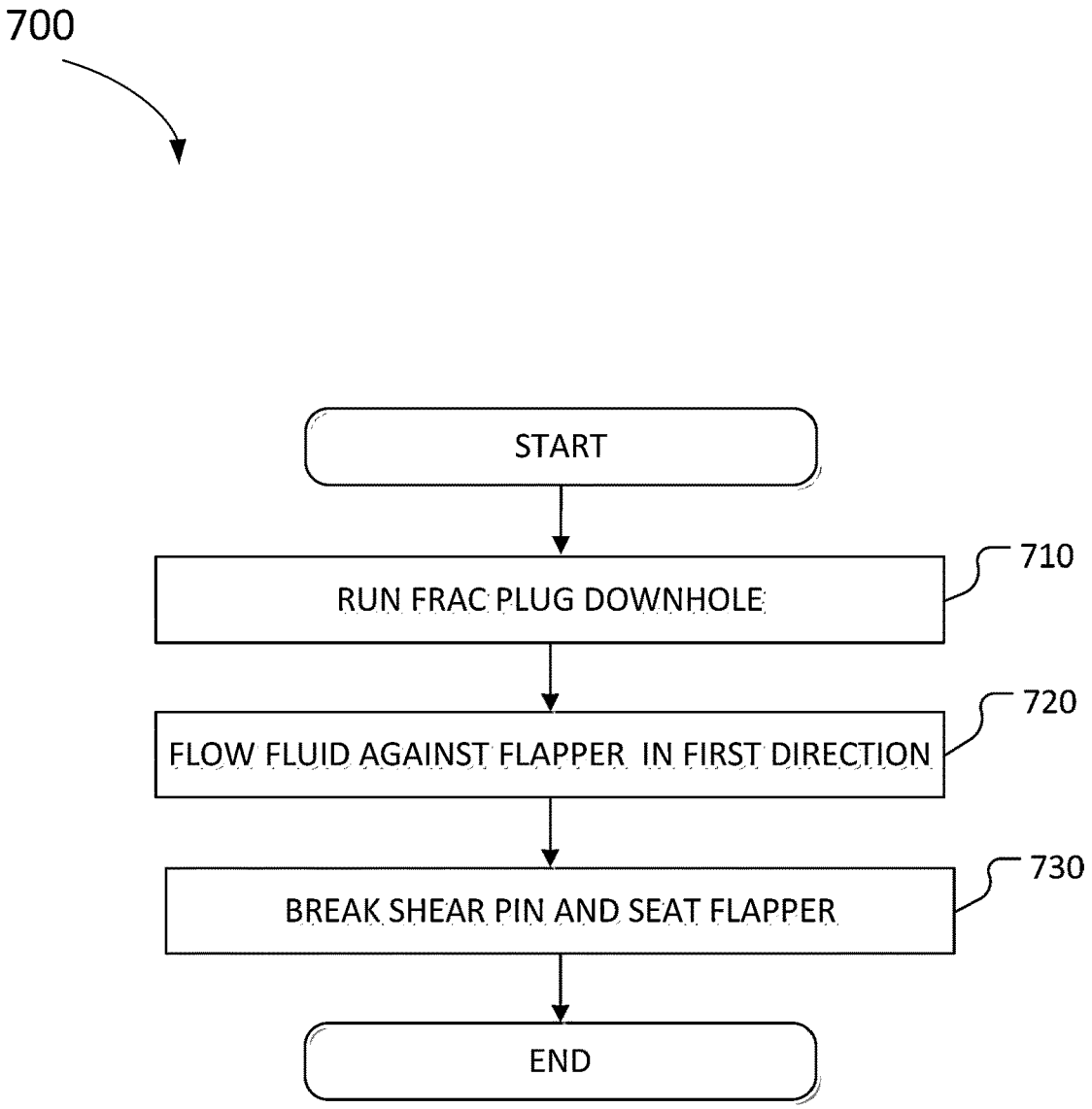
FIG. 7 depicts a method for utilizing a downhole tool with a flapper, according to an embodiment.

FIG. 7 depicts a method 700 for utilizing a downhole tool with a flapper, according to an embodiment. The operations of method 700 presented below are intended to be illustrative. In some embodiments, method 700 may be accomplished with one or more additional operations not described, and/or without one or more of the operations discussed. Additionally, the order in which the operations of method 700 are illustrated in FIG. 7 and described below is not intended to be limiting.

At operation 710, a downhole tool, such as a frac plug, may be run in the hole and set at a desired depth. The downhole tool may be run in a hole with a flapper in an open position, which may allow fluid to flow through a mandrel. When run in a hole, a shear pin may be configured to be inserted through a flapper.

At operation 720, fluid may flow against an upper surface or lower surface of the flapper in the first direction. The fluid flowing against the upper or lower surface of the flapper causes the flapper to exert a force against the shear pin that is greater than a force threshold, wherein the force threshold is associated with an amount of force required to shear the shear pin.

At operation 730, responsive to the forces against the shear screws being greater than the force threshold, the shear pin may shear. This may enable the flapper may rotate from an open position to a closed position, wherein the flapper is seated across a mandrel of the downhole tool.

Figure 8:
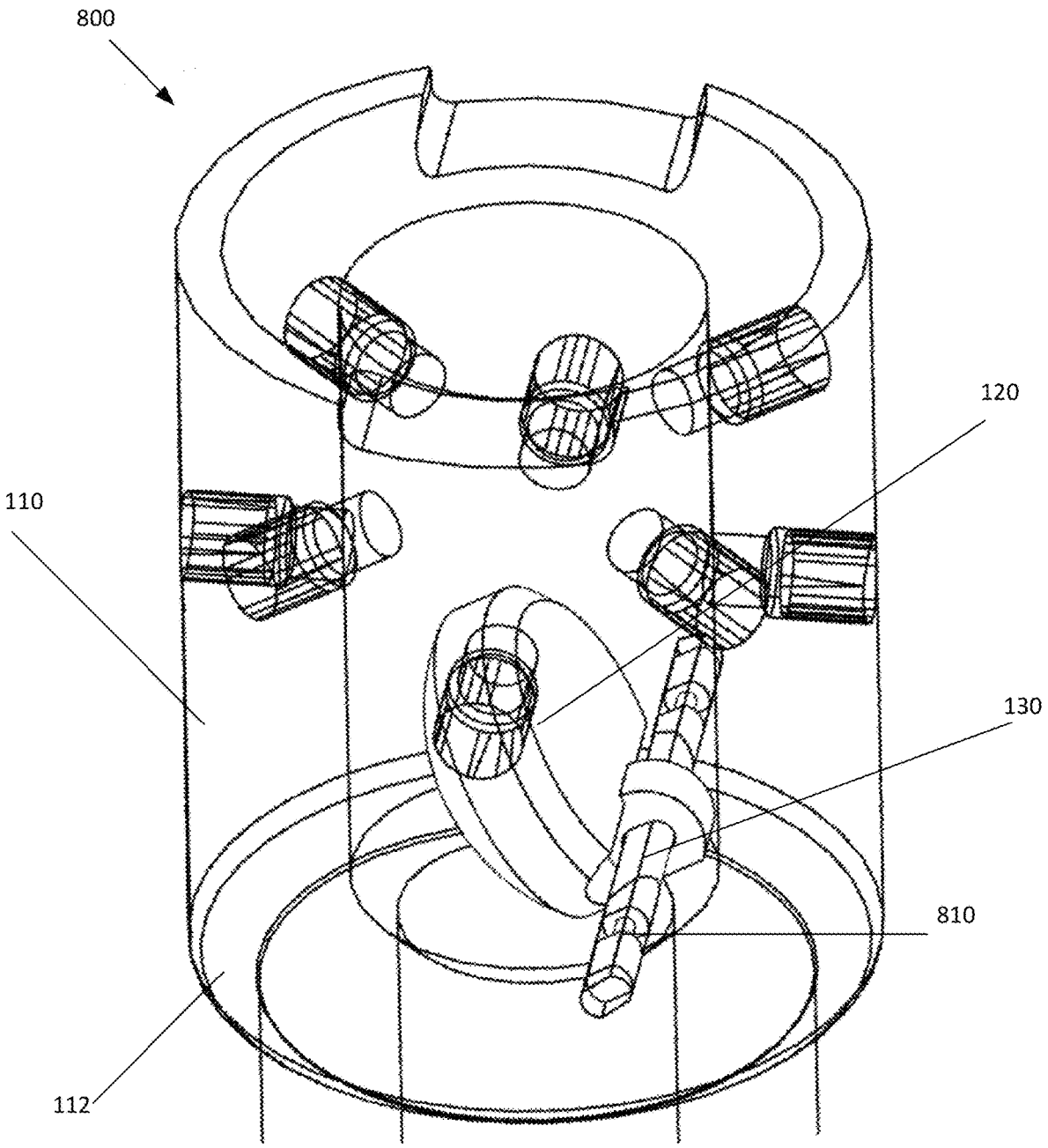
FIG. 8 depicts a perspective view of a downhole tool, according to an embodiment.
Figure 9:
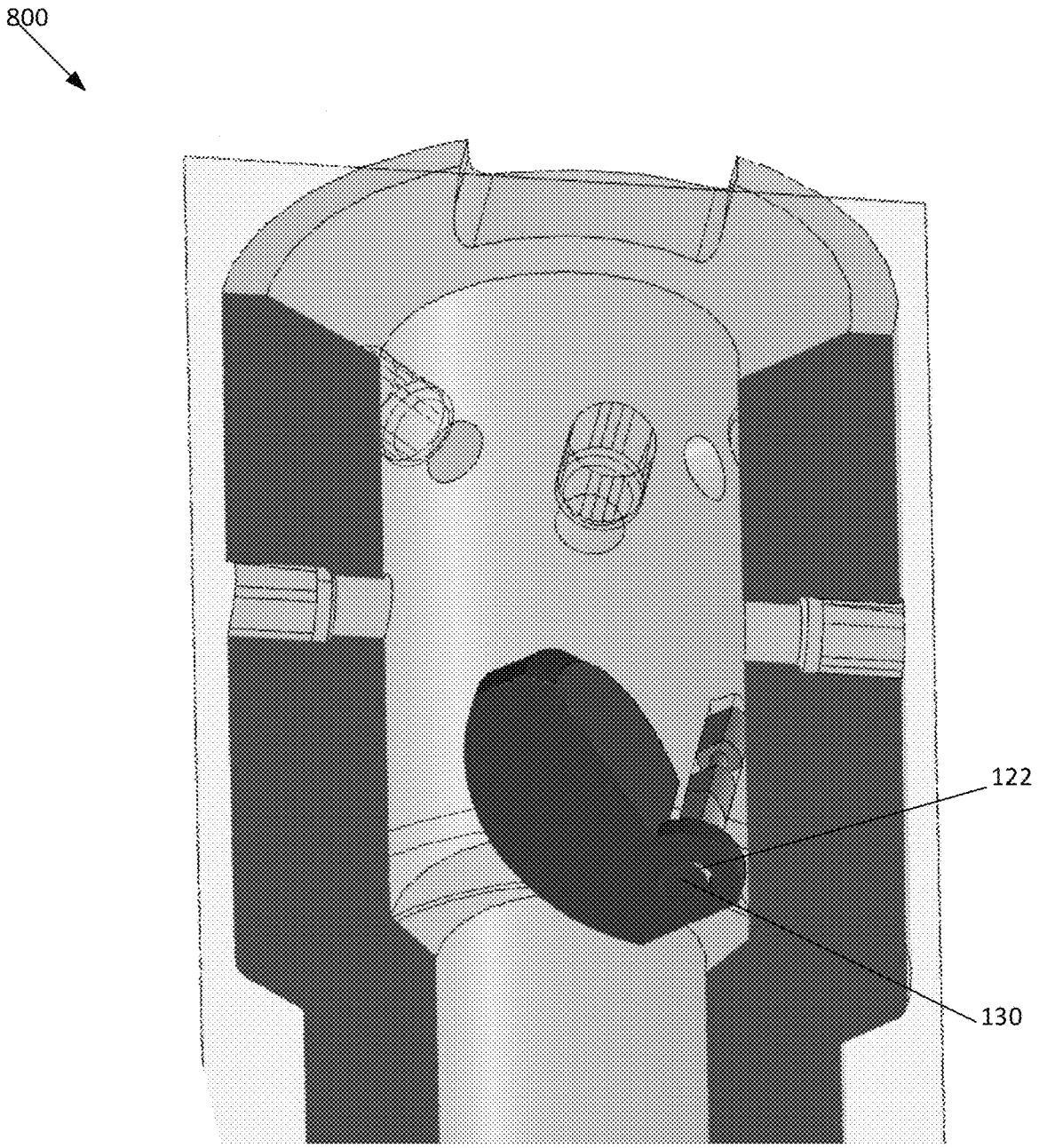
FIG. 9 depicts a cross-sectional view of the downhole tool, according to an embodiment.

FIG. 8 depicts a perspective view of a downhole tool 800, according to an embodiment. FIG. 9 depicts a cross-sectional view of the downhole tool 800. Elements depicted in FIGS. 8 and 9 may be described above, and for the sake of brevity, a further description of these items may be omitted. The downhole tool 800 may be a frac plug that is configured to isolate areas of a geological formation. The downhole tool 800 may include a mandrel 110, flapper 120, and shaft 130 with weak points 810.

As depicted in FIG. 8, shaft 130 may have weak points 810, which have a reduced diameter across shaft 130. The reduced or varying the diameter across shaft 130 may create weak points 810 that are configured to shear or break responsive to a pressure applied across the weak points 810 being greater than a pressure threshold. Responsive to the pressure being applied to shaft 130 being greater than the pressure threshold, weak points 810 may break. This may cause flapper 120 to be seated on profile 112 and form a seal across mandrel 110.

Furthermore, as depicted in FIG. 9, shaft 130 and corresponding slot 122 may not have a circular cross-section. The cross-section of shaft 130 and slot 122 may restrict the rotation of flapper 120 when shaft 130 is intact before weak points 810 break. For example, shaft 130 and corresponding slot 122 may have a square, rectangular, oblong, etc. cross-section. The geometry of shaft 130 and corresponding slot 122 may restrict the rotation of flapper 120 before the rotation of flapper 120. Furthermore, to rotate flapper 120 it may be necessary to deform shaft 130 within slot 120.

Figure 10:
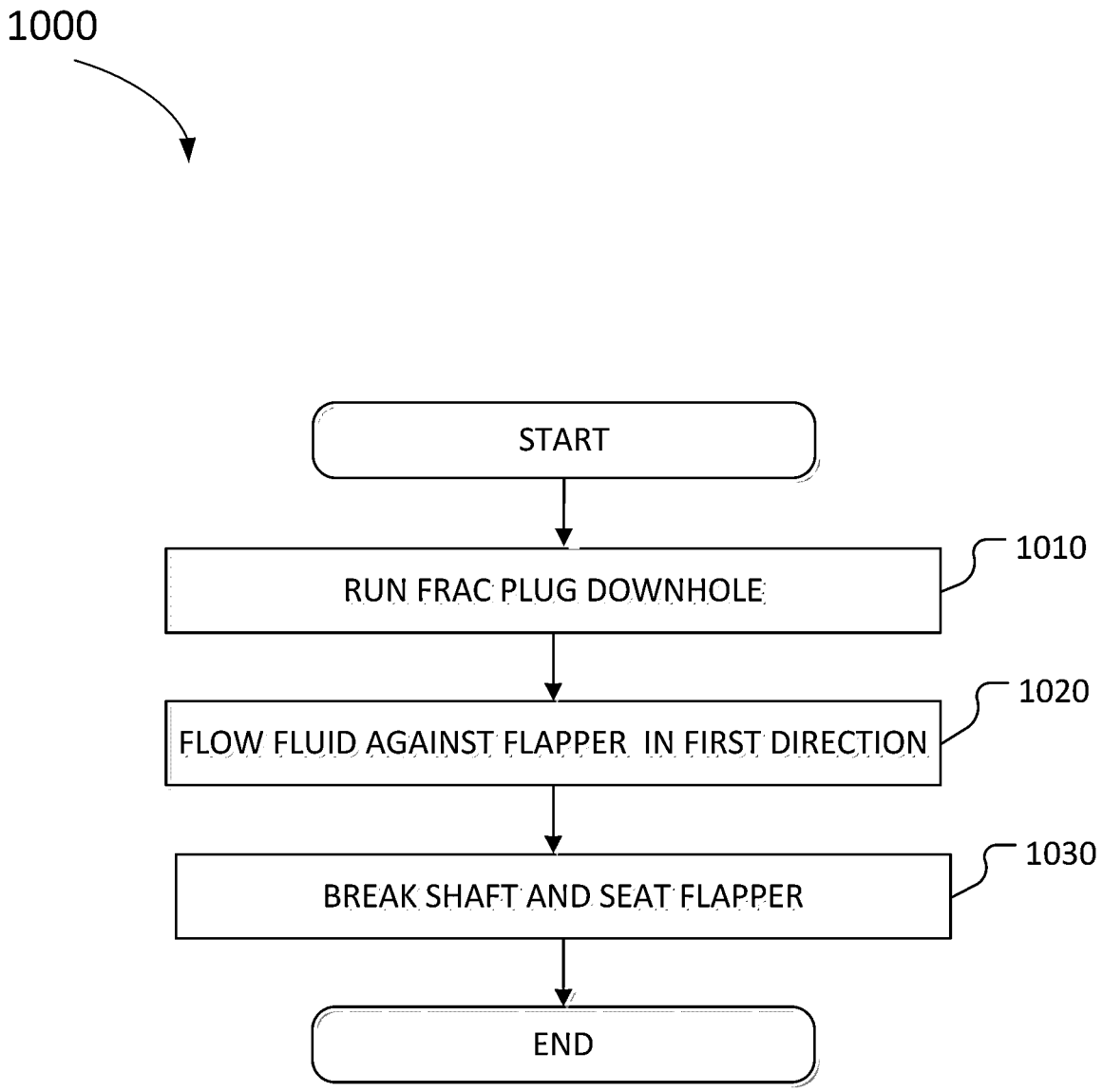
FIG. 10 depicts a method for utilizing a downhole tool with a flapper, according to an embodiment.

FIG. 10 depicts a method 1000 for utilizing a downhole tool with a flapper, according to an embodiment. The operations of method 1000 presented below are intended to be illustrative. In some embodiments, method 1000 may be accomplished with one or more additional operations not described, and/or without one or more of the operations discussed. Additionally, the order in which the operations of method 1000 are illustrated in FIG. 10 and described below is not intended to be limiting.

At operation 1010, a downhole tool may be run in a hole and set at a desired depth. The downhole tool may be run in a hole with a flapper in an open position, which may allow fluid to flow through a mandrel. When run in a hole, a shaft defining an axis of rotation may have at least one shear point that is configured to break based on a pressure threshold. In embodiments, the shear points on the shaft may be caused by a reduced inner diameter across the shaft.

At operation 1020, fluid may flow in a first direction against an upper surface or lower surface of the flapper, wherein the first direction may be an uphole or downhole direction. The fluid flowing against the upper or lower surface of the flapper may cause the flapper to exert a force on the weak points that are greater than a first force threshold, wherein the first force threshold is associated with an amount of force required to shear the weak points of the shaft.

At operation 1030, responsive to the force against the flapper being greater than the force threshold, weak points may break. This may enable the flapper may rotate from an open position to a closed position, wherein the flapper is seated across a mandrel of the downhole tool.

Figure 11:
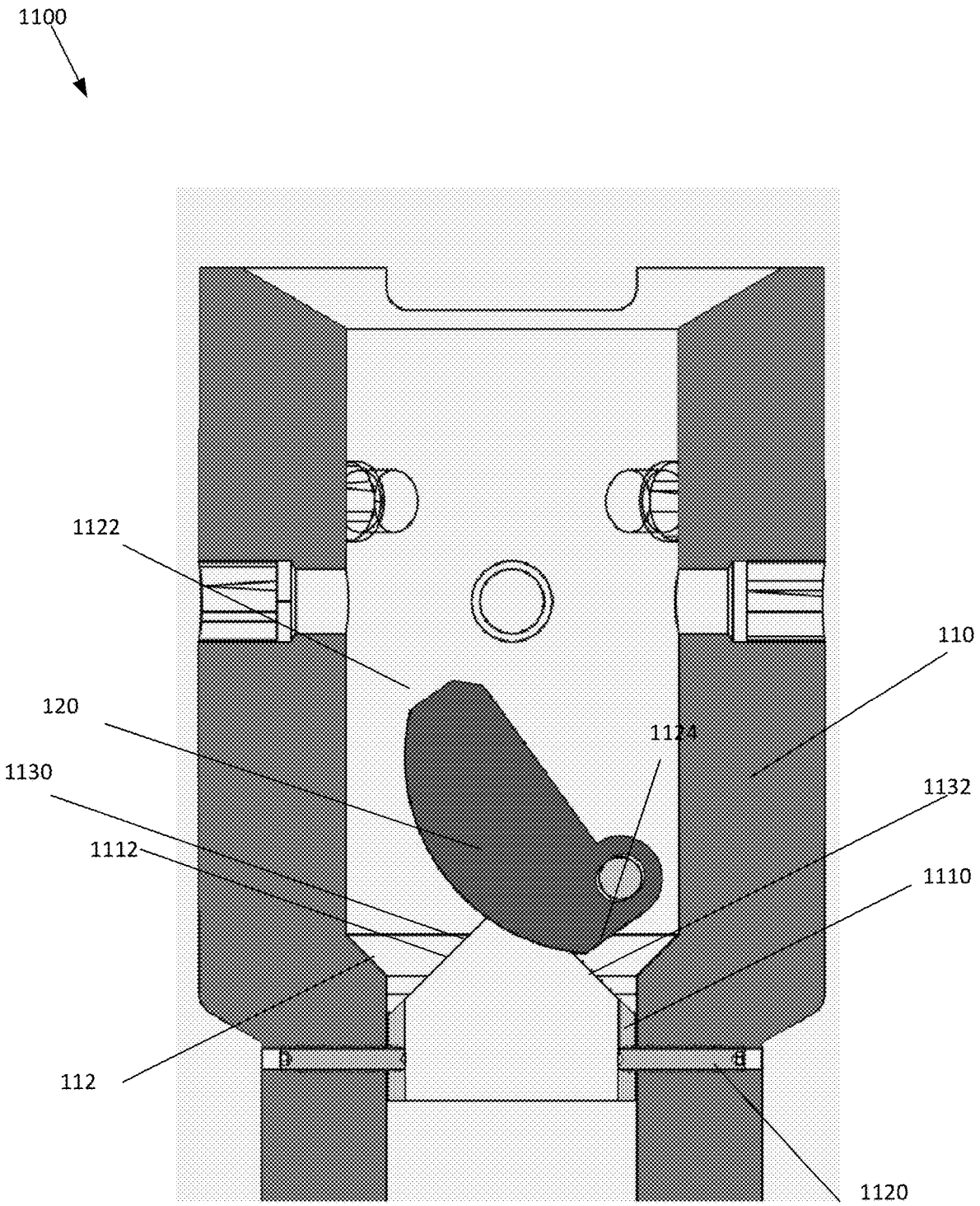
FIG. 11 depicts a cross-sectional view of a downhole tool, according to an embodiment.
Figure 12:
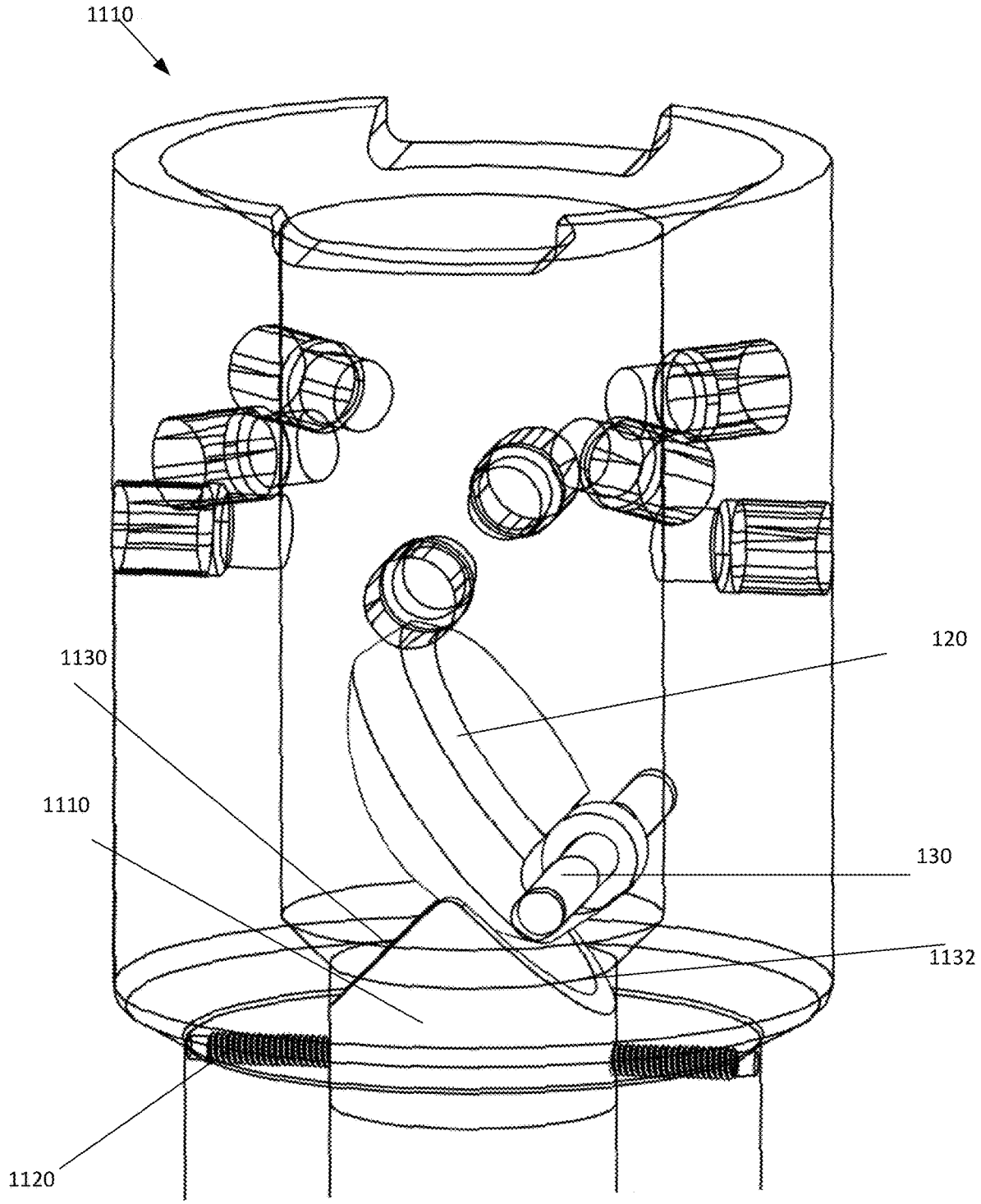
FIG. 12 depicts a perspective view of the downhole tool, according to an embodiment.

FIG. 11 depicts a cross-sectional view of a downhole tool 1100, according to an embodiment. FIG. 12 depicts a perspective view of downhole tool 1100. Elements depicted in FIGS. 11 and 12 may be described above, and for the sake of brevity, a further description of these items may be omitted. Downhole tool 1100 may be a frac plug that is configured to isolate areas of a geological formation. Downhole tool 1100 may include mandrel 110, flapper 120, and insert 1110 coupled to mandrel 110 via temporary coupling mechanisms 1120.

Insert 1110 may be an internal housing, device, etc. that is configured to have a smaller diameter than that of mandrel 110 below profile 112. An upper surface 1112 of insert 1110 may be configured to be positioned above profile 112, and prop open flapper 120 when insert 1110 may be directly coupled to mandrel 110 via temporary coupling mechanisms 1120, wherein temporary coupling mechanisms 1120 are directly inserted into mandrel 110. Insert 1110 may have a smaller inner diameter than that of mandrel 110. This may cause an increase in velocity to the fluid at a location proximate to, and between, a contact point of flapper 120 and insert 1110 and shear pins 1120. This increase in velocity may assist in the shearing of shear pins 1120.

In other words, an upper surface 1112 of insert 1110 may retain flapper 120 in the open position when flapper 120 is run in a hole, and when temporarily coupling mechanisms 112 are intact. Responsive to increasing pressure against flapper 120 by increasing a fluid flow rate through mandrel 110, flapper 120 may translate these forces against insert 1110 and temporary coupling mechanisms 1120. When the pressure against temporary coupling mechanism 1120 is greater than the first force threshold, the temporary coupling mechanism 1120 will shear. This will cause insert 1110 to travel downhole and allow flapper 120 to be seated on profile 112, wherein profile 112 is positioned on the inner diameter of mandrel 110 and does not move relative to mandrel 110. As such, the flapper 120 may not be seated until after the movement of insert 1110. Furthermore, after temporarily coupling mechanisms 1120 shear, upper surface 1130 of insert 1110 may no longer contact the lower surface of flapper 120, which may enable the independent movement of flapper 120 relative to insert 1110.

As depicted in FIG. 11, insert 1110 may be configured to contact and maintain flapper 120 in an open position at a location at the bottom surface of flapper 120, such that first end 1122 of the flapper 120 is not positioned on profile 112. Insert 1110 and flapper 120 may create a first flow path 1130, which may be in front of the apex of insert 1110, and a second flow path 1132, which may be behind the apex of insert 110. This may cause a first flow path 1130 through insert 1110 to receive less fluid than a second flow path 1132 through insert 1110 due to the differences in cross-sectional areas being exposed and/or covered by flapper 120. Due to the angularity of flapper 120 resting on insert 1110 and the volume of fluids flowing through the first flow path 1130 and the second flow path 1132 fluid flowing through mandrel 110 may apply more pressure against flapper 120 than if flapper 120 contacted insert 1130 at a location between the apex of flapper 120 and second end 1224.

However, one skilled in the art may appreciate that insert 1110 may be any device positioned above or below flapper 120 within mandrel 110 that is also coupled to the inner diameter of mandrel 110. In embodiments, where mandrel 110 is positioned above the flapper In other embodiments shear pins 1120 may be any device that may be used to temporarily hold insert 1110 in place. Further, insert 1110 may have an integrated seat for the flapper 120, where the flapper 120 may move and seat on in a second position after temporarily shear pin 1120 is removed.

Figure 13:
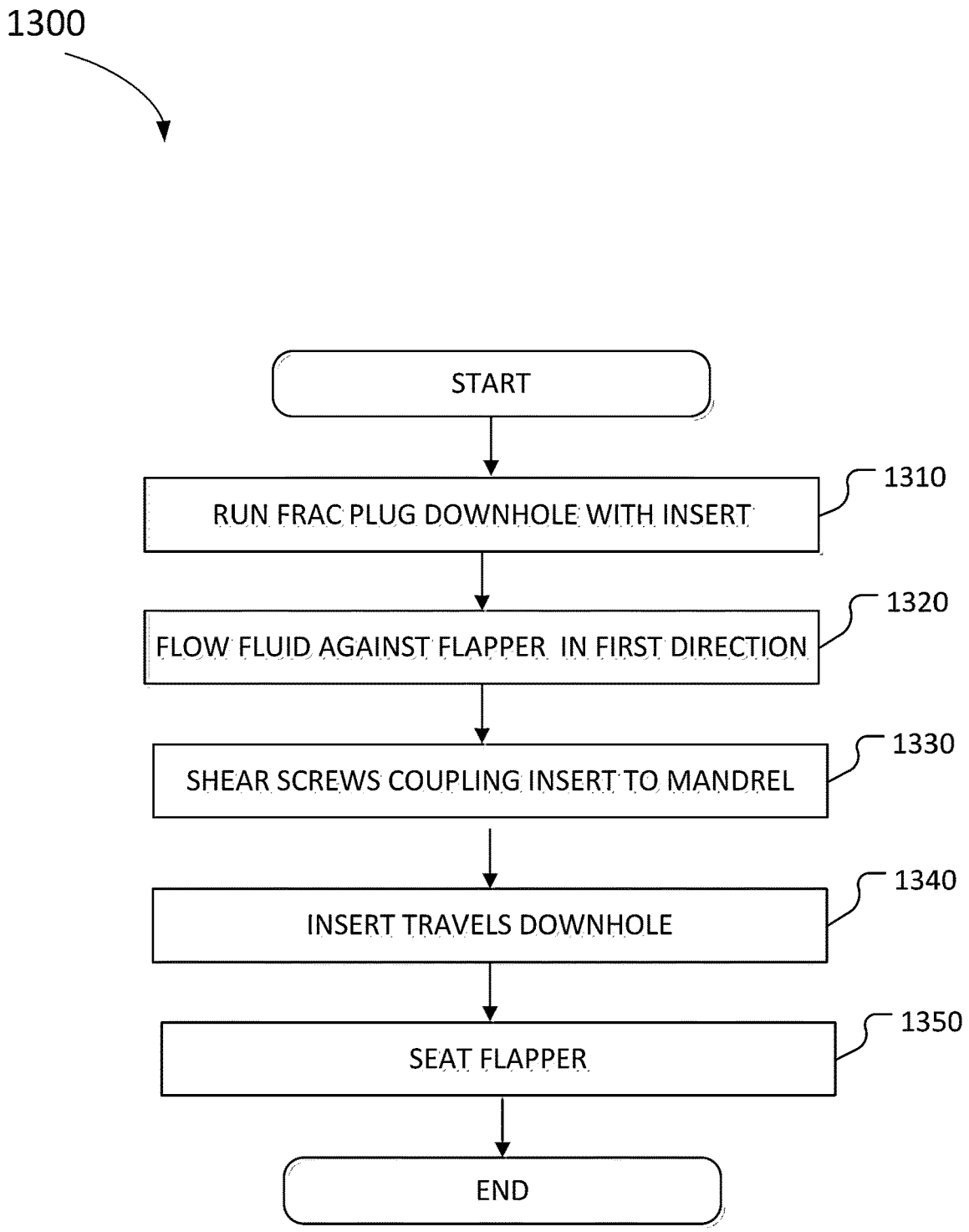
FIG. 13 depicts a method for utilizing a frac plug with a flapper, according to an embodiment.

FIG. 13 depicts a method 1300 for utilizing a frac plug with a flapper, according to an embodiment. The operations of method 1300 presented below are intended to be illustrative. In some embodiments, method 1300 may be accomplished with one or more additional operations not described, and/or without one or more of the operations discussed. Additionally, the order in which the operations of method 1300 are illustrated in FIG. 13 and described below is not intended to be limiting.

At operation 1310, a downhole tool may be run in a hole and set at a desired depth. The downhole tool may be run in a hole with a flapper in an open position, which may allow fluid to flow through a mandrel. When run in a hole, the upper surface of an insert may retain the flapper in an open position and not extend against a profile within the mandrel, wherein the flapper is unable to be seated against the profile within the mandrel. In embodiments, an upper surface of the insert may have a smaller inner diameter than that of the mandrel and the flapper and may be positioned above the profile within the mandrel, wherein the profile reduces the inner diameter of the mandrel. Due to the placement and geometry of the mandrel, the flapper may be able to rotate above the insert but may not be fully seated against the profile.

At operation 1320, fluid may flow in a first direction against an upper surface or lower surface of the flapper, wherein the first direction may be an uphole or downhole direction. The fluid flowing against the upper or lower surface of the flapper causes the flapper to exert a force against the insert that is greater than a first force threshold, wherein the first force threshold is associated with an amount of force required to shear the temporary coupling mechanisms that couple the insert to the mandrel.

At operation 1330, responsive to the forces created by the flapper against the insert being greater than the force threshold, the temporary coupling mechanisms may break.

At operation 1340, when the temporary coupling mechanisms break the insert may travel downhole and no longer restrict the rotation of the flapper.

At operation 1350, the flapper may rotate from an open position to a closed position, wherein the flapper is seated on the profile forming a seal across a mandrel of the downhole tool.

Figure 14:
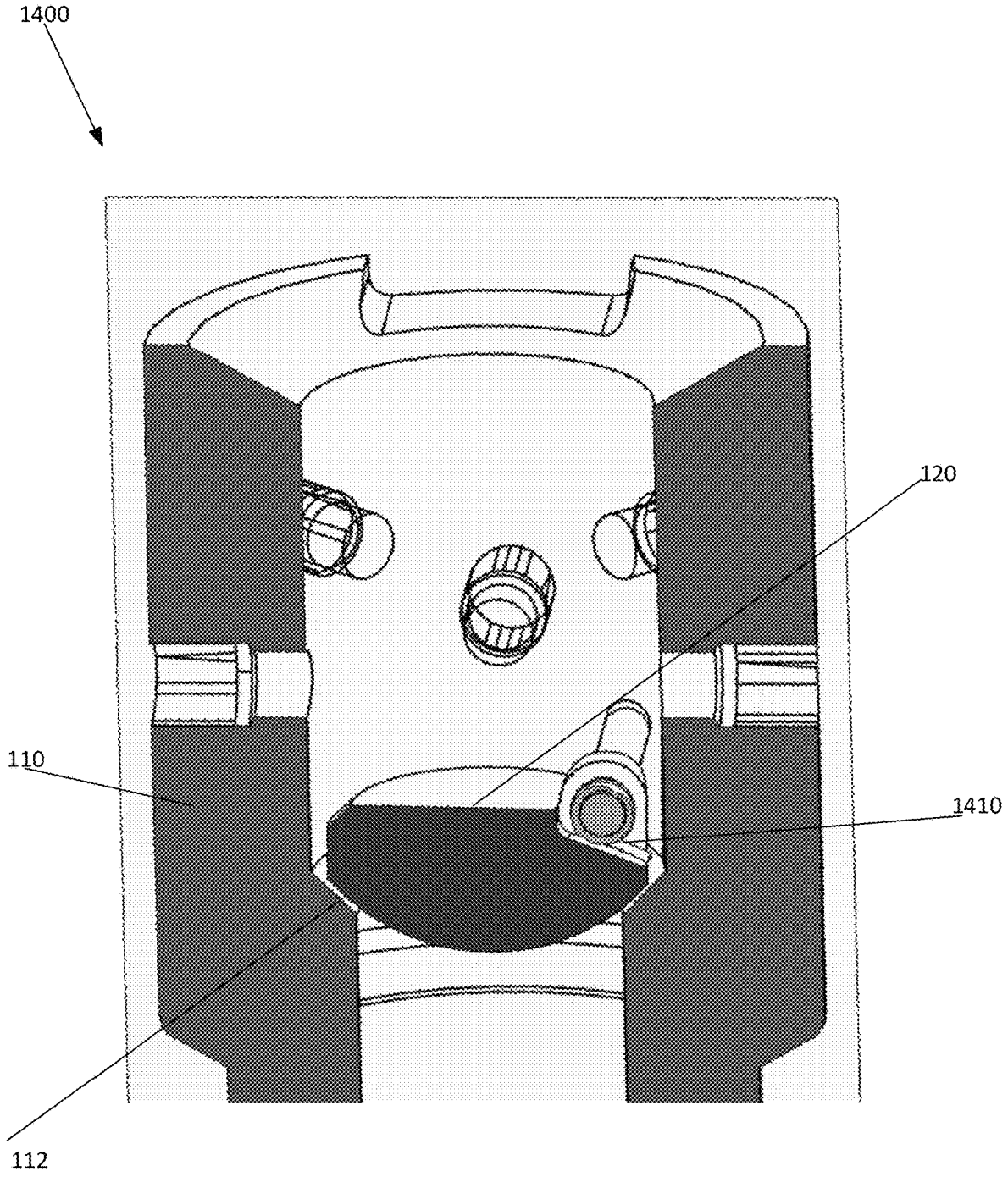
FIG. 14 depicts a cross-sectional of a downhole tool, according to an embodiment.
Figure 15:
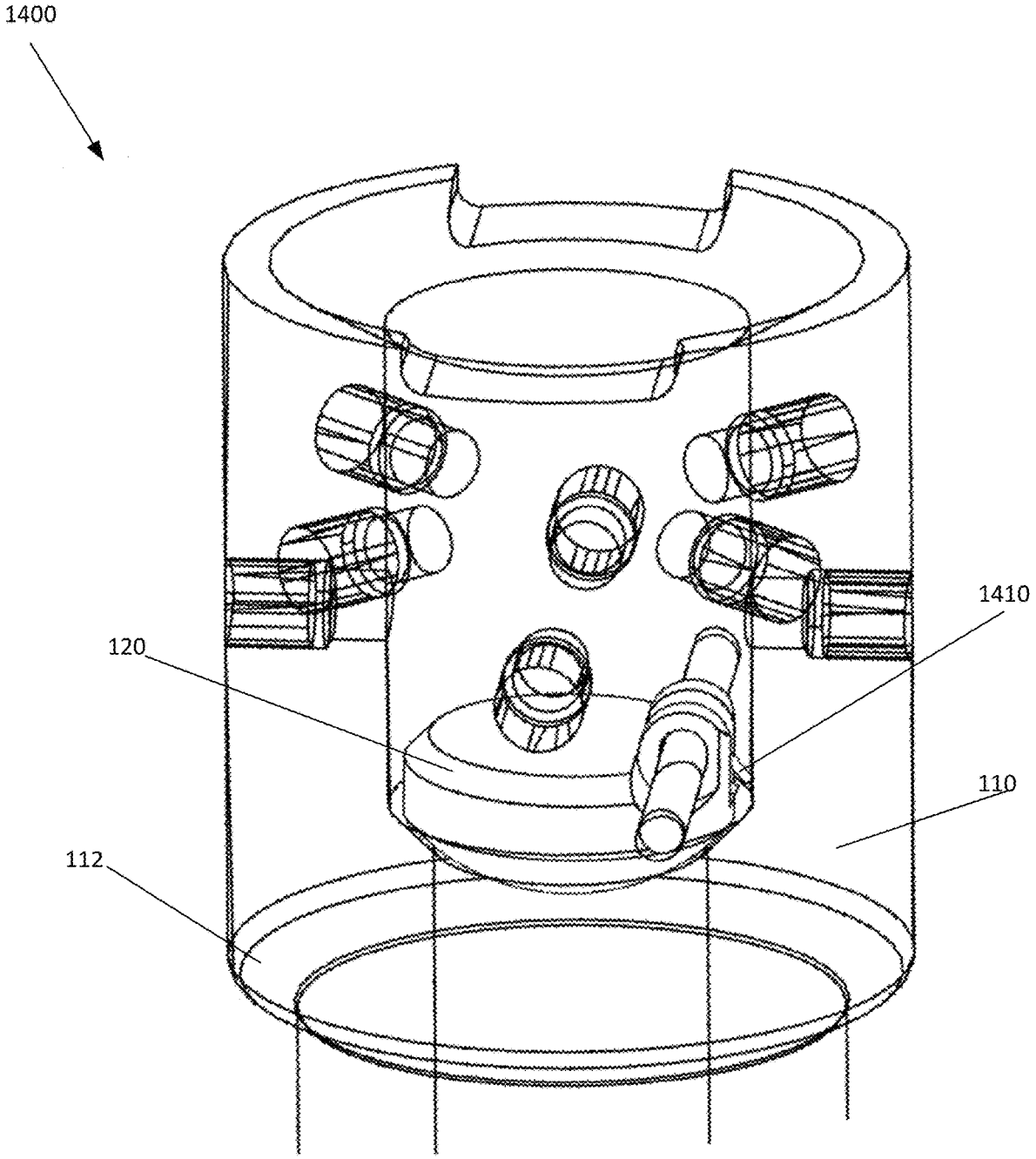
FIG. 15 depicts a perspective view of the downhole too, according to an embodiment.

FIG. 14 depicts a cross-sectional of a downhole tool 1400, according to an embodiment. FIG. 15 depicts a perspective view of the downhole tool 800. Elements depicted in FIGS. 14 and 15 may be described above, and for the sake of brevity, a further description of these items may be omitted. The downhole tool 800 may be a frac plug that is configured to isolate areas of a geological formation. Downhole tool 1400 may include mandrel 110, flapper 120, and torsion spring 1410.

Torsion spring 1410 may be a spring that is twisted along its axis to store mechanical energy when it is twisted. The mechanical energy stored by torsion spring 1410 may exert torque in a first direction against flapper 120, which may retain flapper 120 in an open position unless a greater force is applied in a second direction. In embodiments, the force exerted by the torsion spring may be associated with a rotating threshold, which is necessary to overcome to rotate flapper 120 in a second direction.

When running in a hole, torsion spring 1410 may be configured to apply a force in a first direction against flapper 120 to retain the flapper in the open position. Accordingly, flapper 120 may be normally positioned in an open position when fluid does not flow through downhole tool 1400. Responsive to flowing fluid through the inner diameter of the mandrel in a second direction, the pressure against flapper 120 may increase past a rotating threshold. When the pressure against flapper 120 is greater than the first force threshold, flapper 120 may rotate in the first direction and be seated against profile 112, wherein the first force threshold is associated with the amount of torque generated by the torsion spring. Responsive to decreasing the pressure against flapper 120 to be less than the first force threshold, flapper 120 may automatically rotate in a second direction and no longer be seated against profile 112 due to the constant force applied by torsion spring 1410 against flapper 120.

Figure 16:
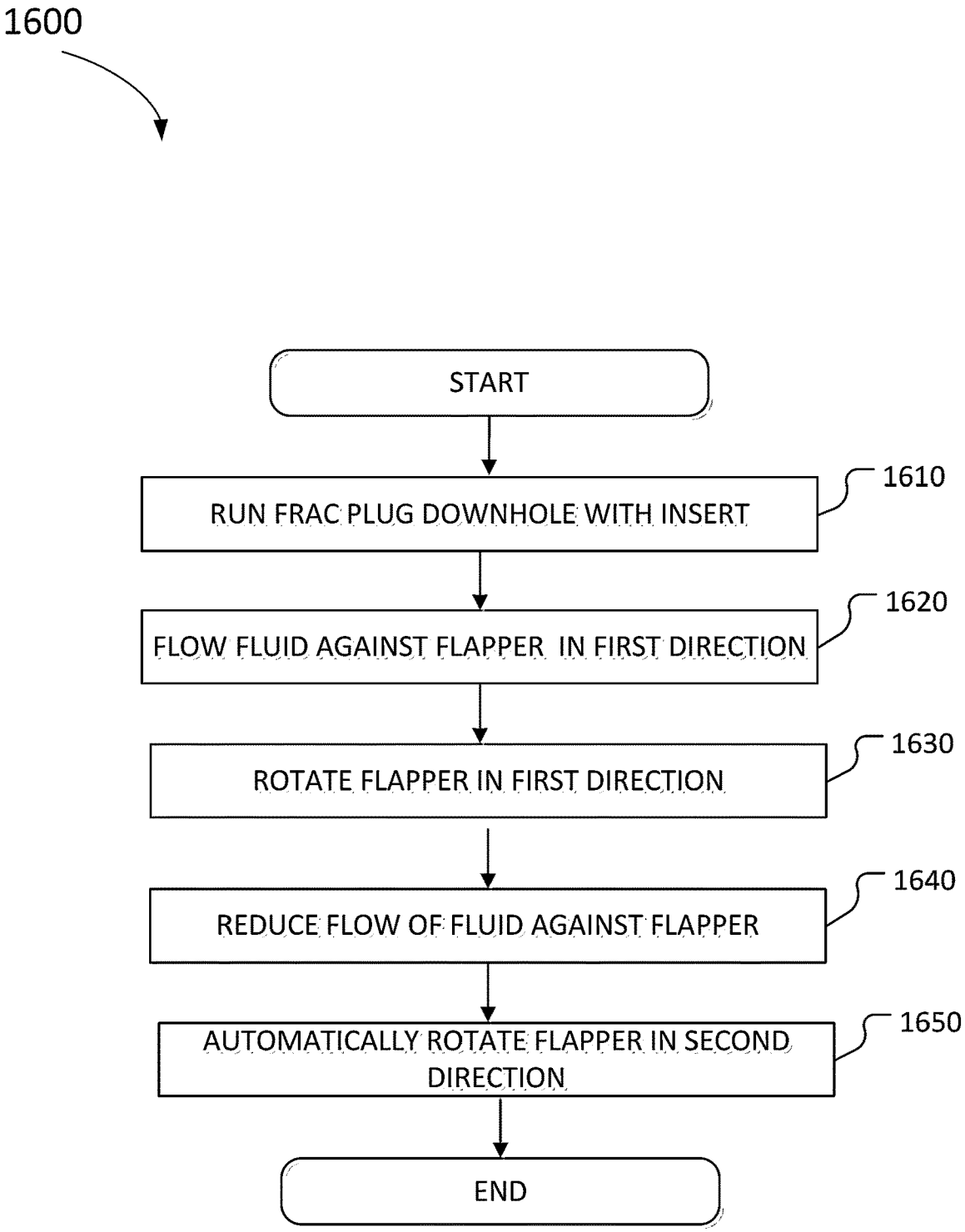
FIG. 16 depicts a method for utilizing a downhole tool with a flapper, according to an embodiment.

FIG. 16 depicts a method 1600 for utilizing a downhole tool with a flapper, according to an embodiment. The operations of method 1600 presented below are intended to be illustrative. In some embodiments, method 1600 may be accomplished with one or more additional operations not described, and/or without one or more of the operations discussed. Additionally, the order in which the operations of method 1600 are illustrated in FIG. 16 and described below is not intended to be limiting.

At operation 1610, a downhole tool may be run in a hole and set at a desired depth. The frac plug may be run in a hole with a flapper in an open position, which may allow fluid to flow through a mandrel. In use, a torsion spring may be configured to apply torque against the flapper in a first direction, which may maintain the flapper in an open position until sufficient force is applied against the flapper in a second direction.

At operation 1620, fluid may flow against an upper surface in a second direction. The fluid flowing against the upper may cause the flapper to exert a force against the torsion spring in the second direction that is greater than a first force threshold, wherein the first force threshold is associated with the amount of torque generated by the torsion spring.

At operation 1630, responsive to the force against the torsion spring being greater than the force threshold, the flapper may rotate and be positioned against a profile within a mandrel of the frac plug.

At operation 1640, the force against the upper surface of the flapper may be reduced to less than the first force threshold.

At operation 1650, the flapper may automatically rotate to the open position due to the constant force being applied to the flapper by the torsion spring.

Figure 17:
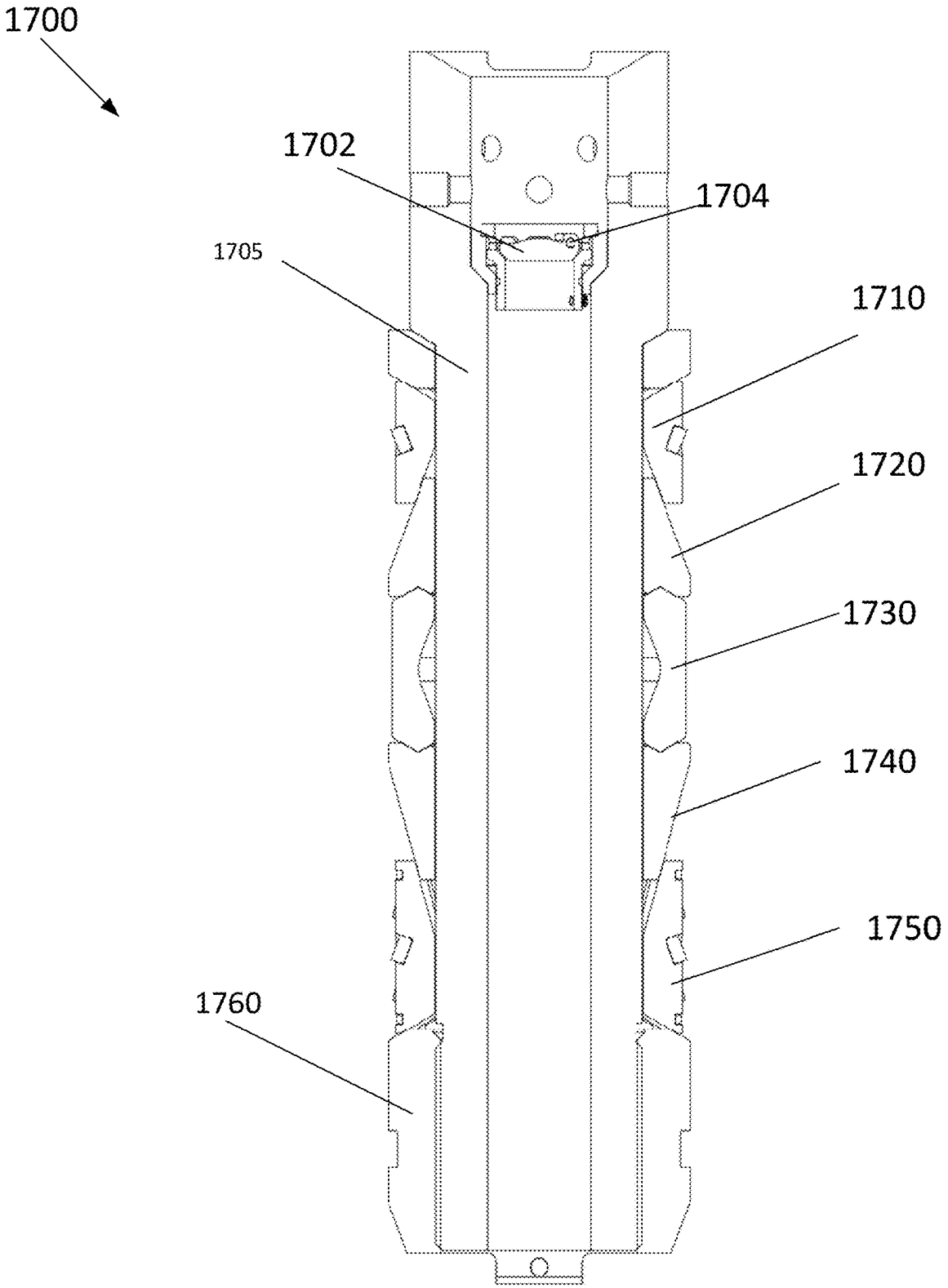
FIG. 17 depicts a cross-sectional of a downhole tool, according to an embodiment.

FIG. 17 depicts a cross-sectional of a downhole tool 1700, according to an embodiment. Elements depicted in FIG. 17 may be described above. FIG. 17 depicts an embodiment of a rotatable flapper 1702 with a shaft 1704 positioned within the mandrel 1705. Any of the flapper systems described above can be used in place of rotatable flapper 1702 within frac plug 1700. One skilled in the art will appreciate that frac plug 1700 may include conventional slips 1710, upper cone 1720, packing element 1730, lower cone 1740, and lower slips 1750. In other embodiments, slip 710 may be eliminated.

These conventional elements may be positioned with flapper 1702 and may be used to isolate areas of a well above and below the frac plug.

The upper slips 1710 may be configured to radially expand/break based on the movement of the upper cone 1720. The upper cone 1720 may be positioned between the upper slips 1710 and the packing element 1730. The upper cone 1720 may be configured to engage with the upper slips 1710 to radially expand/break the upper slips 1710. In embodiments, the upper cone 1720 may be coupled to the mandrel 1705 via breakable threads or any other breakable coupling mechanism. The threads on the upper cone 1720 may be configured to directly couple the upper cone 1720 with the mandrel of the frac plug to maintain the upper cone 1720 in a non-deployed state even with incidental movement from the packing element 1730.

The packing element 1730 may be a packer/rubber/elastic material that is configured to compress and radially expand across the wellbore. The packing element 1730 may be configured to compress based on a pressure differential/forces across the packing element 1730 caused by the upper cone 1720 and the lower cone 1740 trapping these pressures/forces during frac plug setting and/or while fracing operation above the frac plug after setting.

The lower cone 1740 may be positioned between the packing element 1730 and the lower slips 1750. The lower cone 1740 may be configured to engage with the lower slips to radially expand or break the lower slips. In embodiments, the lower cone 1740 may be coupled to the mandrel via breakable threads or any other breakable coupling mechanism. The threads on the lower cone 1740 may be configured to directly couple the lower cone 1740 with the mandrel of the frac plug to maintain the lower cone 1740 in a non-deployed state even with incidental movement from the lower slips 1750 or packing element 1730.

The lower slips 1750 may be positioned adjacent to the lower cone 740 and cap 1760. The lower slips 1750 may be configured to radially expand or break based on the movement of the lower cone 1740. In embodiments, the lower slips 750 may be coupled to the mandrel via breakable threads or any other breakable coupling mechanism, The threads on the lower slips 1750 may be configured to directly couple the lower slips 1750 with the mandrel of the frac plug to maintain the lower slips 1750 in a non-deployed state even with incidental movement from the lower cone 1740.

Figure 18:
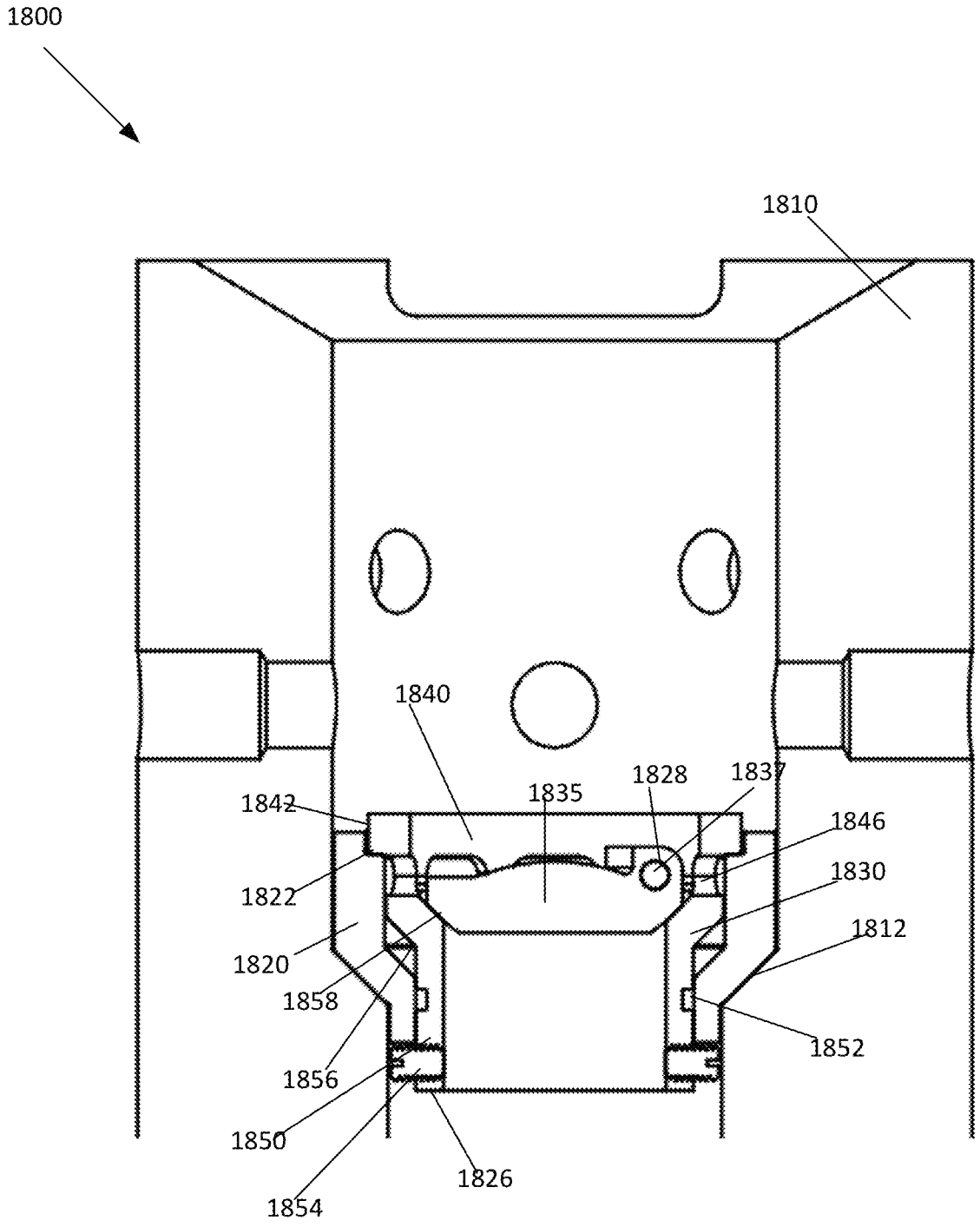
FIG. 18 depicts a downhole tool, according to an embodiment.

FIG. 18 depicts a downhole tool in 1800, according to an embodiment. Downhole tool 1800 may be a frac plug that is configured to isolate areas of a geological formation. Downhole tool 1800 may include a mandrel 1810, insert 1820, and housing 1830.

Mandrel 1810 may be a shaft, cylindrical, rod, etc. that is configured to form a body of downhole tool 1800. Mandrel 1810 may include a profile 1812 that reduces the inner diameter of mandrel 1810 which limits the movement of insert 1820 in a first direction. Profile 1812 may be a ledge that is perpendicular to a central axis of the downhole tool 100 or maybe a tapered sidewall that gradually and incrementally decreases the inner diameter of mandrel 1810. In other embodiments, there may be no need to have profile 1812.

Insert 1820 may be a tool formed of composite material, or any desired material. Insert 1820 may be configured to be mounted on an inner diameter of mandrel 1810 of downhole tool 1800. Insert 1820 may include ledge 1822, sloped sidewall 1824, distal end 1826, and pin slots 128. Insert 1820 may be threaded, glued pinned, or fixed to mandrel 1810 using any other method. In other embodiments, insert 1820 may be just part of the body 1810 or may be removed completely and may be replaced by a profile on body 1810.

Ledge 1822 may decrease an inner diameter across insert 1820, which may be configured to act as a stopper, no-go, etc. to restrict the movement of an upper portion of housing 1830 in a first direction, wherein the first direction may be downhole. More specifically, ledge 1822 may be configured to receive a projection 1842 of the upper portion 1840 of the housing 1830. Responsive to positioning projection 1842 of upper portion 1840 on ledge 1822, movement of housing 1830 in the first direction may be restricted when upper portion 1840 and lower portion 1850 are coupled together. However, when upper portion 1840 and lower portion 1850 are decoupled, ledge 1822 may not restrict the movement of lower portion 1850 in the first direction.

Sloped sidewall 1824 may be configured to gradually decrease the inner diameter of the insert 1820. Sloped sidewall 1824 may be configured to receive lower portion 1850 of housing 1830 to restrict the movement of lower portion 1850 in the first direction responsive to decoupling upper portion 1840 and lower portion 1850. In embodiments, an angle of the sloped sidewall may correspond to the tapered sidewall of mandrel 1810. Furthermore, a seal may be formed between an outer diameter of the lower portion 1850 and an inner diameter of insert 1820 when the lower portion 1850 and upper portion 1840 are de-coupled.

The distal end 1826 of the insert 1820 may project away from an inner diameter of the mandrel 1810 to create a lower shelf. The distal end 1826 may be configured to interface with elements locking outcrops 1854 of lower portion 1850 to limit the movement of lower portion 1850 in a second direction. In certain embodiments, tool 1800 may not include an insert 1820 and housing 1830 may be directly mounted on mandrel 1810, wherein mandrel 1810 may have a similar inner profile as that described above.

Pin slots 1828 may be holes, slots, indentations, etc. positioned through inserts that are configured to selectively receive flapper pin 1837. Specifically, pin slots 1828 may have a first end that is positioned on the proximal end of insert 1820 and extends towards a distal end of insert 1820. Pin slots 1828 may extend in a linear path with a larger length than that of flapper pin 1837, which may allow flapper pin 1837 to be free-floating within pin slots 1828. The proximal end of pin slots 1828 may be configured to be contained between the upper portion 1840 and lower portion 1850 of housing 1830 when upper portion 1840 and lower portion 1850 are coupled together. After flapper pin 1837 is disengaged from pin slots 1828 it may be unlikely that flapper pin 1837 can reengage with pin slots 1828 down well.

Housing 1830 may be formed of brass, composite, aluminum, cast iron, or any other material that can dissolve over time due well fluid and temperature. Housing 1830 may be configured to be positioned within insert 1820 when run in a hole, wherein elements of housing 1830 may all be coupled together when run in a hole. The housing 1830 may include a flapper 1835, upper portion 1840, and lower portion 1850. In other embodiments, the flapper 1835 and flapper pin 1837 may be replaced by a disc or any geometrical shape.

Flapper 1835 may be a rotatable disc formed of brass, composite, aluminum, cast iron, or any other material that can dissolve over time due well fluid and temperature. Flapper 1835 may be configured to rotate from a position blocking an inner diameter of the tool 1800 to a position allowing fluid to flow around flapper 1835. When flapper 1835 extends across an annulus within the tool, flapper 1835 may be configured to be positioned on a flapper seat 158 within the lower portion of housing 1830. When flapper 1835 is positioned on flapper seat 158, whether upper portion 1840 and lower portion 1850 are coupled or decoupled from each other, a first area on the first side of flapper 1835 may be isolated from a second area on the second side of flapper 1835. Accordingly, flapper 1835, lower portion 1850, and insert 1820 may extend across an inner diameter of mandrel 1810 to form a seal across a plane through mandrel 1810 to isolate the first area from the second area. However, if flapper 1835 is rotated to not extend across the annulus within tool 1800 and/or upper portion 1840 is not positioned within insert 1820, then the first area and second area may not be isolated from each other. Flapper 1835 may be a free-floating component that is mounted inside the housing 1830 via a flapper pin 1837 and insert 1820. Flapper 1835 may be configured to apply forces when pressure or forces are applied to flapper 1835 from above against stress points 1846 within housing 130 to separate upper portion 1840 and lower portion 1850 of housing.

Flapper pin 1837 may be free-floating, which enables flapper 1835 to move along a linear axis confined by pin slots 1828. Flapper pin 1837 is configured to extend across an entirety of the diameter of the housing and has ends that are configured to be inserted into pin slots 1828. When flapper pin 1837 is inserted into the pin slots 1828, flapper 1835 may be coupled to housing 1830 and insert 1820. In embodiments, flapper pin 1837 may be an integral portion of flapper 1835 or may be removably coupled to flapper 1835, such that flapper pin 1837 may slide out of flapper 1835.

Upper portion 1840 of housing 1830 may be configured to be selectively coupled to lower portion 1850 of housing 1830 based on a pressure applied across housing 1830 and a direction of fluid flowing within tool 1800, wherein both upper portion 1840 and lower portion 1850 are positioned within an inner diameter of mandrel 1810 when run in hole. Upper portion 140 may include projection 1842 and stress points 1846. In other embodiments, upper portion 1840 and lower portion 1850 may be two elements connected via stress points 1846 which can be a shear screw.

Projection 1842 may be positioned on a proximal end of upper portion 1840 and project away from a central axis of housing 1830 to increase the outer diameter of upper portion 1840. Projection 1842 may be configured to slide onto and sit on ledge 1822. Responsive to positioning projection 1842 on ledge 1822, movement of upper portion 1840 in the first direction may be limited.

Stress points 1846 may be positioned between upper portion 1840 and lower portion 1850 of housing 1830. Stress points 1846 may be weak points where upper portion 1840 becomes disconnected from lower portion 1850, wherein stress points 1846 extend in parallel to a central axis of mandrel 1810, wherein stress points 1846 are not coupled to mandrel 1810, insert 1820 or flapper 1835. In embodiments, stress points 1846 may be configured to receive a force from flapper 1835 against flapper seat 1858 responsive to moving the free-floating flapper 1835 to be positioned on flapper seat 158. More specifically, when fluid is flowing through the inner diameter of tool 1800, flapper 1835 may receive forces created by the flowing fluid/pressure. This may allow flapper 1835 to sit on the lower portion 1850 of the housing 1830, and cause flapper 1835 to apply pressure against the stress points 1846. When flapper 1835 applies a pressure greater than a stress threshold of stress points 1846, stress points 1846 may break causing upper portion 1840 and lower portion 1850 to become detached and separated. Then, lower portion 1850 of housing may move in the first direction towards the distal end of the housing 1830 with the flapper 1835 and flapper pin 1837.

Lower portion 1850 of housing 1830 may be configured to be selectively coupled to upper portion 1840 of housing 1830. Lower portion 1850 may include seal 1852, locking outcrops 1854, and tapered sidewall 1856. Seal 1852 may be configured to be positioned between an outer diameter of the lower portion 1850 and an inner diameter of inset 1820. Seal 1852 may not allow communication through a gap between insert 1820 and housing 1830 when lower portion 1850 is still connected to the upper portion 1850 of housing 1830, and when flapper 1835 is positioned on flapper seat 1858. Locking outcrops 1854 may be positioned on the distal end of lower portion 1850 below the distal end 1826 of insert 1820.

Locking outcrops 1854 may increase the outer diameter of the lower portion 1850 such that the diameter of locking outcrops 1854 is larger than that of distal end 1826. Due to locking outcrops 1854 being larger than that of the outer diameter of the distal end 1826 and the internal diameter of the lower end of insert 1820, locking outcrops 1854 may restrict the movement of lower portion 1850 in a second direction relative to insert 1820, wherein the second direction is an opposite position from the first direction. This may assist in disengaging the upper portion 1840, flapper 1835, and flapper pin 1837 from the lower portion 1840 when there is a flow back through tool 1800. Further, by restricting the lower portion 1850 from moving in the second direction using locking outcrops 1854 and the first direction using ledge 1822, the lower portion 1850 can be milled with the frac plug as an integral piece. Hence facilitating milling operations if needed.

Tapered sidewall 1856 may be a slanted sidewall that is configured to be positioned on slanted sidewall 1824 of insert 1820 after lower portion 1850 is sheared from upper portion 1840.

Flapper seat 1858 may be positioned between stress points 1846 and locking outcrops 1854. Flapper seat 1858 may be configured to reduce the inner diameter across lower portion 1850, such that flapper 1835 may be positioned on flapper seat 1858. Responsive to flapper 1835 receiving pressure above the flapper 1835 in the first direction, flapper 1835 may translate these forces to lower portion 1830 through flapper seat 1858, which may shear stress points 1846.

In embodiments, upper portion 1840 and lower portion 1850 of housing may be coupled together via stress points 1846 within the inner diameter of mandrel 110. As such, upper portion 1840, lower portion 1850, and stress points 1846 may be positioned within the same vertical plane extending through the inner diameter of mandrel 1810. This may enable upper portion 1840 and lower portion 1850 to be sheared along a plane that extends in parallel to a central axis of the mandrel 1810. In other embodiments, the upper portion 1840 and lower portion 1830 can be two separate pieces coupled together with stress point 1845

After the shearing of upper portion 1840 from lower portion 1830, flapper 1835 may still be encompassed by upper portion 1840 and lower portion 1830 until fluid flows in an opposite direction that used to shear upper portion 1840 from lower portion 1830.

Figure 19:
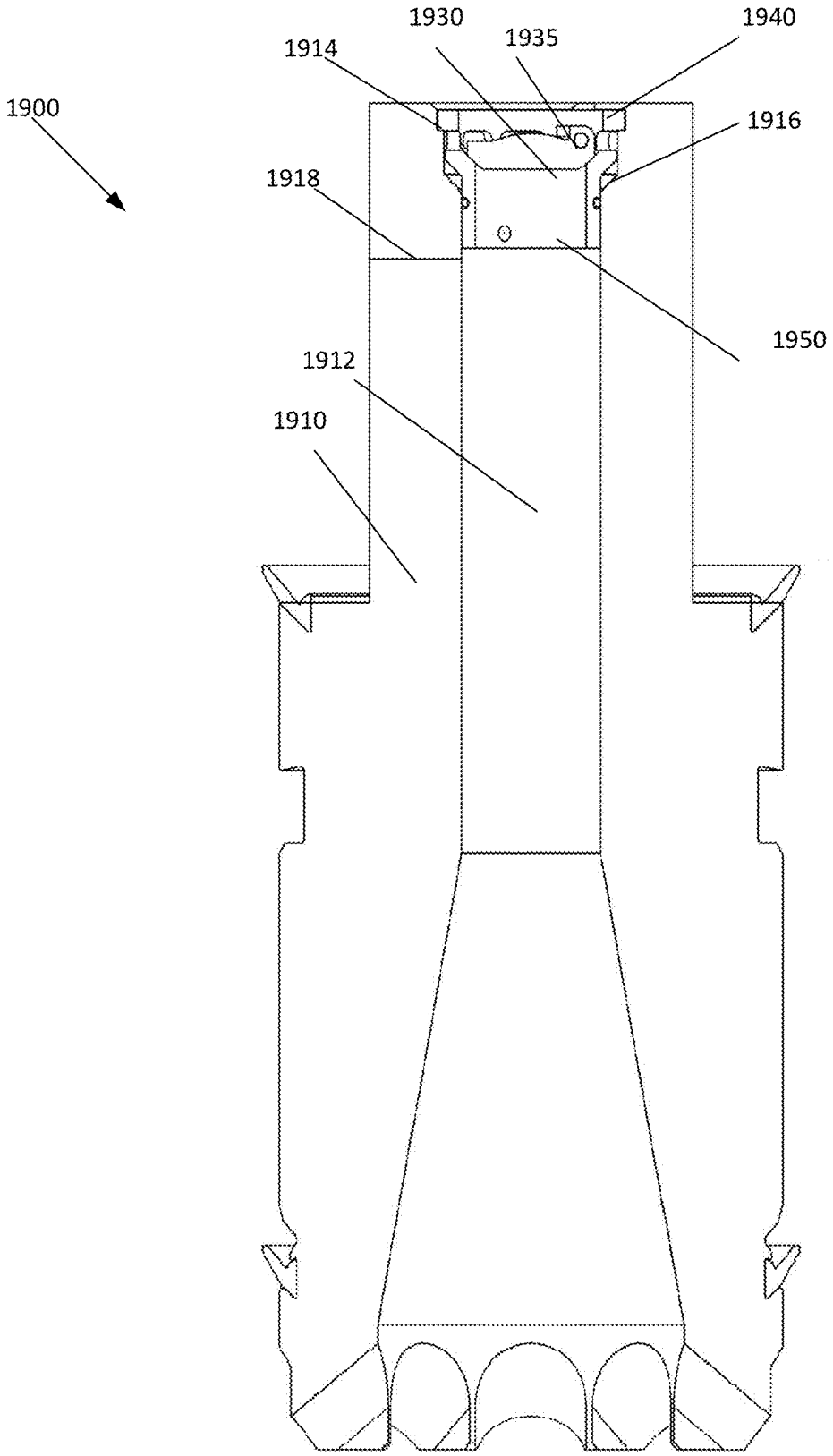
FIGS. 19 and 20 depict a downhole tool, according to an embodiment.
Figure 20:
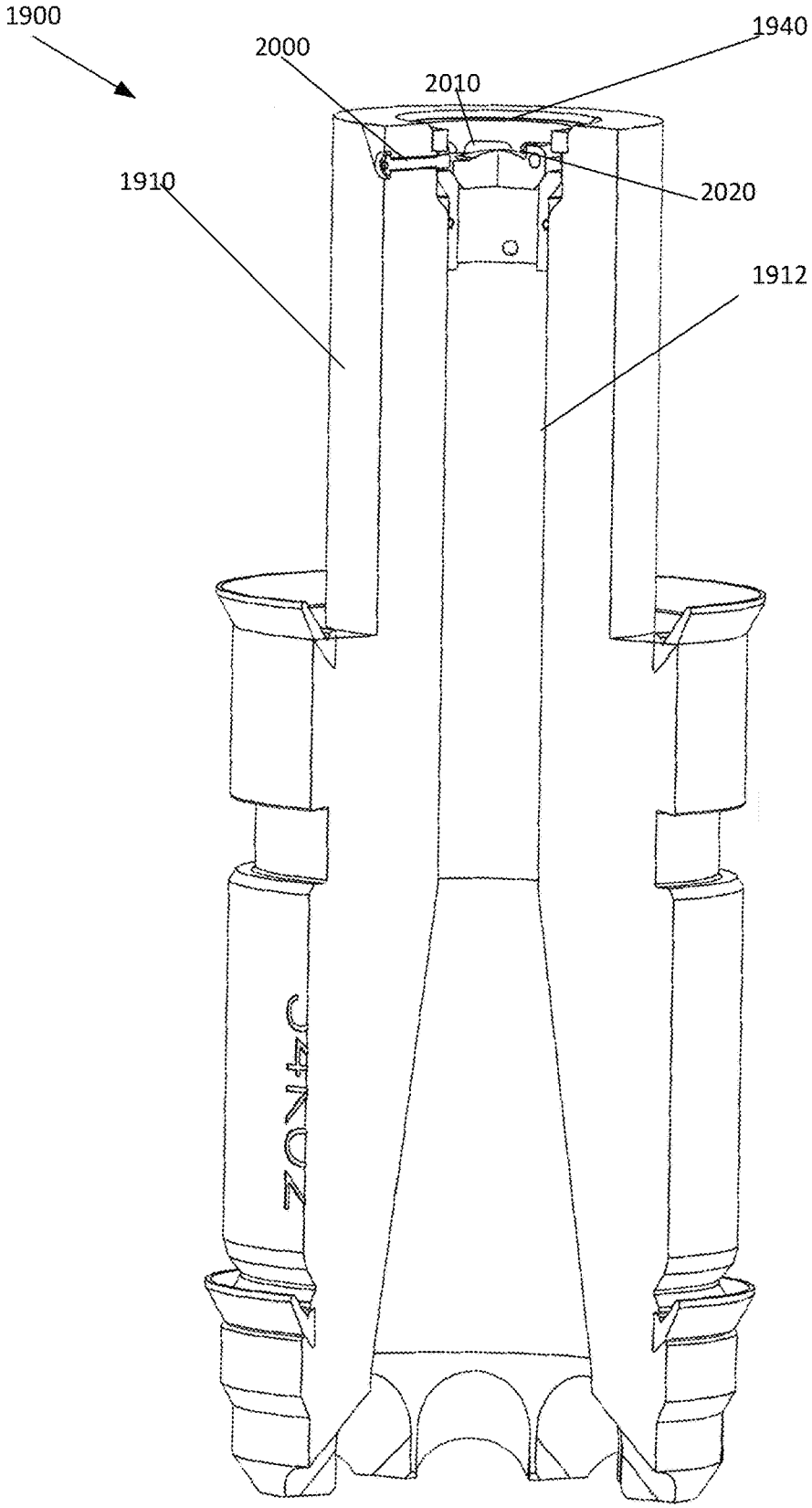

FIGS. 19 and 20 depict a downhole tool 1900, according to an embodiment. Elements depicted in FIGS. 19 and 20 may be described above, and for the sake of brevity, a further description of these elements may be omitted.

Downhole tool 1900 may be a cartridge, pump down plug, frac plug or any other tool that is configured may be formed of any material including dissolvable material, and may be configured to be positioned downhole. The cartridge may be pumped downhole after running the casing, or be pumped downhole along with the casing, configured to land on a seat, protrusion, keys, or any other profile within a casing that reduces the inner diameter of the casing, wherein the profile of the inner diameter of the casing may limit the downhole movement of downhole tool 1900. In further embodiments, the cartridge may include packers, slips, or other elements that radially expand to limit the downhole movement of downhole tool 1900 within the casing. In embodiments, downhole tool 1900 may be operated similarly to downhole tool 1800 but may not include an insert, and instead relies on a profile on the inner diameter of mandrel 1910.

After positioning downhole tool 1900 at a desirable location within the well, pressure above the cartridge may increase. The pressure above the cartridge may be able to increase due to object 1935 being in the closed position and isolating areas above the cartridge from areas below the cartridge. The increase in pressure may enable testing of the casing to a maximum operating pressure, which may shear housing 1930 but still maintain pressure integrity due to object 1935 remaining in the closed position even after the shearing of housing 140. In other embodiments, the stem/body may have a hole that throttles flow, hence creating differential pressure that allows the lower portion of the housing 1930 to break from the upper portion and slide in the first direction to isolate the hole(s)

After the pressure testing of the casing, fluid may flow in a reverse direction below object 1935, or pressure may be bled off above the flapper, which may allow object 135 and the upper portion of housing 130 to be removed from the cartridge. After object 1935 is removed from the lower portion of housing 1930, pumping may be established through downhole tool 900. In cases where the downhole tool 900 was made out of dissolvable material, this may allow it to accelerate dissolution due to contaminating fresh fluid.

Similar to insert 120, downhole tool 1900 may include ledge 1914, sloped sidewall 1916, and distal end 1912, wherein downhole tool 1900 is a cartridge mounted on a mandrel 19210.

Ledge 1914 may decrease an inner diameter across downhole tool 1900, which may be configured to act as a stopper, no-go, etc. to restrict the movement of an upper portion of housing 1930 in a first direction, wherein the first direction may be downhole. Furthermore, ledge 1914 may retain upper portion 1940 after lower portion 1950 is sheared from housing 1930.

Sloped sidewall 1916 may be configured to gradually decrease the inner diameter of downhole tool 1900. Sloped sidewall 1916 may be configured to receive lower portion 1950 of housing 1930 to restrict the movement of lower portion 1950 in the first direction after decoupling upper portion 1940 and lower portion 1950. This may enable object 1935 to retain a seal across the cartridge even after shearing lower portion 1950 from upper portion 1940. In embodiments, lower portion 1950 may have ports that are configured to allow circulation.

Distal end 1912 may be a passageway through downhole tool 900, where fluid may be pumped through after removing object 135 from housing 130.

In embodiments, distal end 1912 may include ports 1918 that radially extend through downhole tool 1900. The ports 1918 may be positioned below lower portion 1950 when lower portion 1950 is coupled to upper portion 140, and be covered by lower portion 1950 when lower portion 1950 is decoupled from upper portion 1940. Accordingly, after lower portion 1950 is sheared by flowing fluid downhole and positioning lower portion 1950 on sidewall 1916, ports 1918 may be covered. The ports 1918 may be also configured to allow reverse circulation between the area below object 1935 and the area above object 1935 before the shearing of housing 130. This may allow for shearing housing 1930 to shear in a direction from the area below object 1935 towards the area above object 1935. In such a use case, lower portion 1950 may not slide downhole to be positioned on sidewall 1916.

In embodiments, a shear pin 2000 may be configured to extend through mandrel 1910, and into windows 2010 between stress points 2020. Shear pin 2000 may be configured to couple housing 1930 directly to mandrel 1910, wherein shear pin 2000 may be configured to allow housing 1930 to be run in a hole with mandrel 1910. The windows 2010 are opening that separate upper portion 1940 and lower 1950 portion of housing 1930.

Figure 21:
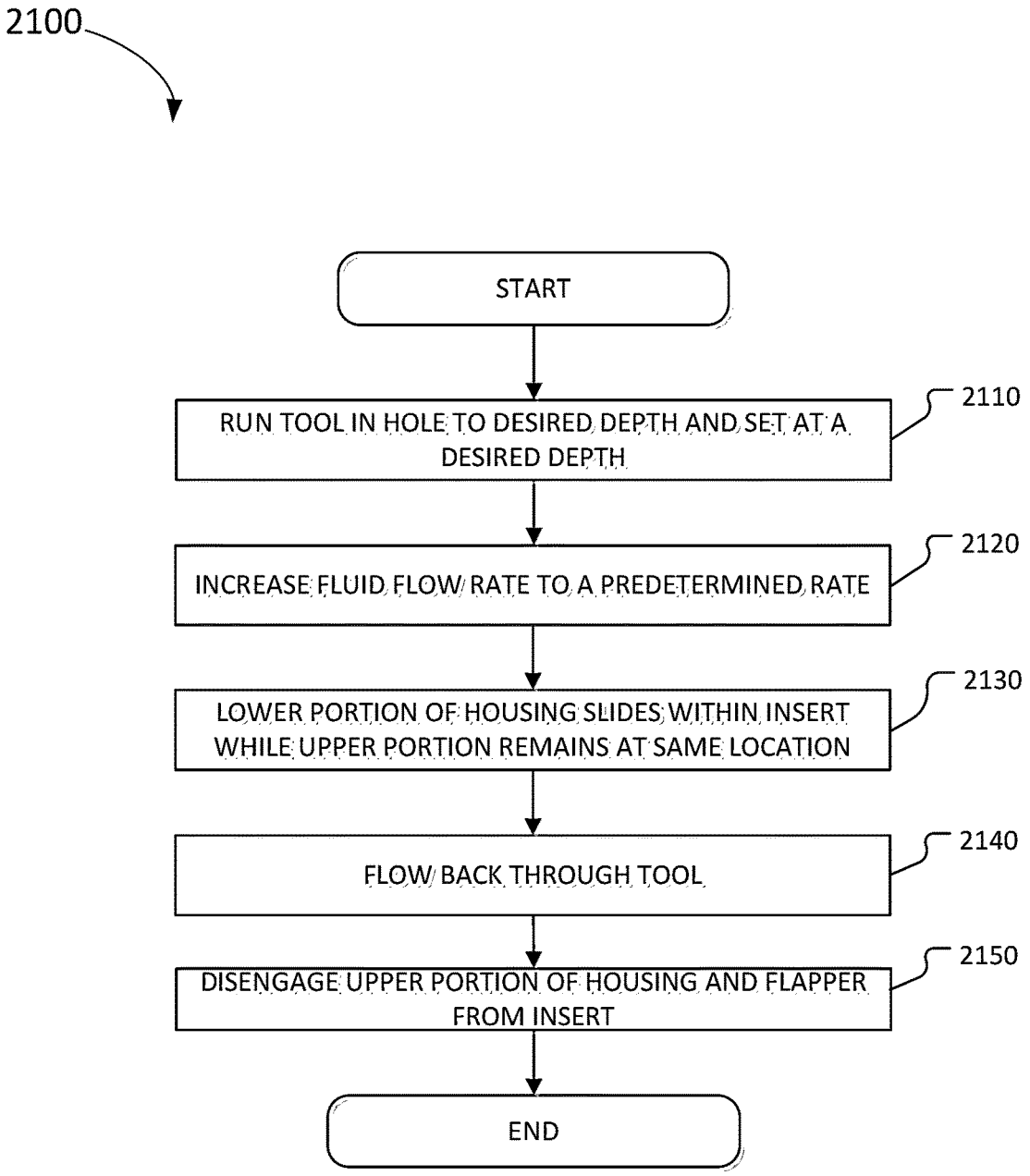
FIG. 21 depicts an operation sequence for shearing a housing with an object, according to an embodiment.

FIG. 21 depicts an operation sequence for shearing a housing with an object, according to an embodiment. The operational sequence presented below is intended to be illustrative. In some embodiments, operational sequence may be accomplished with one or more additional operations not described, and/or without one or more of the operations discussed. Additionally, the order in which the operations of the operational sequence are illustrated in FIG. 21 and described below is not intended to be limiting.

At operation 2110, a downhole tool may be run in the hole and set at the desired depth. The downhole tool may be run in a hole with an object being in a closed position across a shearing housing. When running in hole, the object may form a seal across the shearing in a first location.

At operation 2120, the fluid flow rate through the hole may be increased to a predetermined value, which may create the required pressure above the object to shear the shearing housing. In embodiments, the shearing housing may shear due to pressure above the object, not due to applied forces breaking objects.

At operation 2130, responsive to the fluid flow rate increasing past the predetermined value, the lower portion of the shearing housing may slide downhole within the insert and form a seal at a second location while the upper portion remains at the same location within the hole. To this end, when the lower portion moves downhole the object may correspondingly move, such that there is no relative movement between the lower portion and the object after shearing the lower portion of the housing At operation 2140, fluid may flow or pressure increase in the second direction and interface with the object positioned within the insert.

At operation 2150, based on the fluid flowing in the second direction the object, the object pin, and the upper portion of the housing may flow in the second direction and no longer be engaged or interfaced with the insert. This may allow fluid to flow through the insert, and the lower portion of the housing to stay engaged with the insert.

Although the present technology has been described in detail for illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure, or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A downhole tool comprising:

a mandrel with a hollow interior, a profile that is configured to reduce an inner diameter of the mandrel from a first inner diameter to a second inner diameter;

an object configured to selectively rotate to extend across the mandrel to form a seal;

an insert being temporarily coupled to the mandrel via at least one temporary coupling mechanism, wherein the insert is configured to prop open the object when the insert is coupled to the mandrel, the object is configured to activate the temporary coupling mechanisms to shift the insert downhole.

2. The downhole tool of claim 1, wherein the object forms a seal across the mandrel, the insert having a smaller inner diameter than the profile.

3. The downhole tool of claim 2, wherein an upper surface of the insert has a smaller inner diameter than the inner diameter of the mandrel above the insert.

4. The downhole tool of claim 3, wherein the object forms a seal on the profile after the at least one temporary coupling mechanism shears, wherein before the at least one temporary coupling mechanism shears fluid may flow through the mandrel around the object.

5. The downhole tool of claim 4, wherein the insert is no longer coupled to the mandrel after the temporary coupling mechanisms shear, wherein the temporary coupling mechanisms shear based on forces applied to the insert by the object.

6. A method for zonal isolation comprising:

running a mandrel with a hollow interior downhole, the mandrel including a profile that reduces an inner diameter of the mandrel from a first inner diameter to a second inner diameter;

selectively rotating an object to extend across the mandrel to form a seal;

temporarily coupling an insert to the mandrel, the insert being temporarily coupled to the mandrel via at least one temporary coupling mechanism;

propping open the object via the insert when the insert is coupled to the mandrel, the object is configured to activate the temporary coupling mechanisms to shift the insert downhole.

7. The method of claim 6, further comprising:

forming, via the object, a seal across the mandrel, the insert having a smaller inner diameter than the profile.

8. The method of claim 7, wherein an upper surface of the insert has a smaller inner diameter than the inner diameter of the mandrel above the insert.

9. The method of claim 6, wherein the object forms a seal on the profile after the at least one temporary coupling mechanism shears, wherein before the at least one temporary coupling mechanism shears fluid may flow through the mandrel around the object.

10. The method of claim 9, wherein the insert is no longer coupled to the mandrel after the temporary coupling mechanisms shear, wherein the temporary coupling mechanisms shear based on forces applied to the insert by the object.

* * * * *